United States Patent [19]

Wiethoff et al.

[11] Patent Number: 4,481,862

[45] Date of Patent: Nov. 13, 1984

[54] AUTOMATIC LOADING SYSTEM FOR FIXED AMMUNITION AT GUN ELEVATION

[75] Inventors: Roger H. Wiethoff, Wayzata, Minn.; Bruce G. Heron, Morgan Hill, Calif.

[73] Assignee: FMC Corporation, Chicago, Ill.

[21] Appl. No.: 397,747

[22] Filed: Jul. 13, 1982

[51] Int. Cl.[3] ..... F41F 9/04

[52] U.S. Cl. ..... 89/46

[58] Field of Search ..... 89/45, 46, 47

[56] References Cited

U.S. PATENT DOCUMENTS

| | | | |
|---|---|---|---|
| 1,602,568 | 10/1926 | Conlon | 89/45 |
| 3,122,967 | 3/1964 | Johnson et al. | 89/46 |
| 3,218,930 | 11/1965 | Girouard | 89/46 |
| 3,314,332 | 4/1967 | Wallin | 89/46 |
| 3,331,279 | 7/1967 | Aldrin et al. . | |
| 3,625,107 | 12/1971 | Smith et al. | 89/1.804 |
| 3,625,108 | 12/1971 | Smith et al. | 89/1.814 |
| 3,625,109 | 12/1971 | Cornelison | 89/1.814 |
| 3,625,110 | 12/1971 | Cornelison et al. | 89/1.812 |
| 3,994,202 | 9/1976 | Tidstrom | 89/36 L |
| 4,183,281 | 1/1980 | Hultgren et al. | 89/47 |
| 4,313,363 | 2/1982 | Schreckenberg | 89/46 |

FOREIGN PATENT DOCUMENTS

| | | | |
|---|---|---|---|
| 1172991 | 6/1964 | Fed. Rep. of Germany . | |
| 2027586 | 12/1970 | Fed. Rep. of Germany . | |
| 1578093 | 5/1971 | Fed. Rep. of Germany . | |
| 2428814 | 1/1980 | France . | |
| 2444247 | 7/1980 | France . | |
| 11461 | of 1896 | United Kingdom | 89/45 |
| 9548 | of 1896 | United Kingdom | 89/45 |
| 1251176 | 10/1971 | United Kingdom . | |
| 1523432 | 8/1978 | United Kingdom . | |
| 2087052 | 5/1982 | United Kingdom . | |

OTHER PUBLICATIONS

E-1601a, FMC Program for Upgrading 40-mm 60-mm Caliber Guns, FMC Corporation, Northern Ordinance Division, 3/1/77.

*Primary Examiner*—Stephen C. Bentley

*Attorney, Agent, or Firm*—Henry M. Stanley; Richard B. Megley

[57] ABSTRACT

A turret is movable in azimuth within a turret support structure and a large caliber cannon is movable in elevation within the turret. A turret ammunition handling system includes an automatic loading mechanism for fixed ammunition cartridges configured with stub cases. The system is configured to move the ammunition cartridges between a turret mounted magazine and the cannon breech at the existing elevation of the cannon. The magazine is movable within the turret and has a plurality of cartridge storage cells therein. A stub case ejection container is movable between a position behind the breech opening, where it accepts ejected cartridge stub cases from the breech, and a position extending through a hatch in the gun mantlet, whereupon the stub case is discharged from the turret. Misfired rounds may be removed from the turret and cartridges may be on-loaded and off-loaded from the turret by the automatic loading mechanism. A microprocessor based control is provided to sequence the mechanical components properly to carry out the ammunition handling system operations in accordance with any one of several selected operating modes.

15 Claims, 31 Drawing Figures

133
Pa
T
192
134
136
143
146
186
187
188
144
147
V
191
189
68
142
138
139
182
69
64
183
184
66
29
178
172
67b
167
174
171
164
177
176
166
67a
163
62a
158
196
197
193
194
153
154
159
62b
32
53
42
63
161
162
152
151
148
149
179
181

51
59
57
58
215
217
218
219
221
228
232
232a
232b
233
236
237
238
246
247
248
249
250
251
273
274
276
277
278
281
282
283
284
286
287
288
289
291
292
293

43
49
49a
51
306
52
301
311
308
307
309
49b
303
304
296
299
298
297
51a
294
32
33
36
37
38
44
46
47
48
302

AUTOMATIC LOADING SYSTEM FOR FIXED AMMUNITION AT GUN ELEVATION

BACKGROUND OF THE INVENTION

1. Field of the Invention

This invention relates to an automatic ammunition loading system for a large caliber cannon, and more particularly to such a system which delivers a series of fixed ammunition cartridges from a system magazine to the breech of the cannon at any current cannon elevation.

2. Description of the Prior Art

An ammunition round generally consists of a projectile, a propelling charge and a primer. Large caliber ammunition usually falls into two categories. Separate ammunition is the term applied to ammunition in which all three parts are separate and are brought together only at the breech of a cannon. Semi-fixed ammunition is the term applied to ammunition wherein the projectile is separate but the propellant and the primer are fixed together. Fixed ammunition is the type wherein all three of the component parts of the ammunition are fixed together as a unit. Some large caliber ammunition is of the fixed type although the most widely known types of such ammunition are those which are exemplified by rifle or machine gun shells.

Ammunition loading systems for large caliber cannons mounted on a gun carriage are well known. The barrel of such a cannon is generally controllable in elevation on the carriage and the carriage is in turn controllable in azimuth position. Such a cannon is seen in the disclosure of the Girouard et al U.S. Pat. No. 3,218,930. This disclosure relates to an ammunition handling system wherein a magazine provides both a projectile and a propellant charge to a hoist which lifts the projectile and the charge together upwardly to a carrier. The carrier receives the projectile and the charge together and rotates to the azimuth position of the gun carriage. When the carrier reaches the gun azimuth position, a projectile and charge, referred to as a round hereinafter, is received from the carrier by a cradle on the gun carriage. The cradle is elevated about the gun support trunnions to a position such that the round is adjacent the rear of the gun and the cradle axis is parallel to the axis of the gun bore. The round is transferred from the cradle to a transfer tray and the tray is then swung downwardly to a position which is coaxial with the bore of the gun. The round is then rammed into the breech to complete the transfer from magazine to the gun breech.

U.S. Pat. No. 3,122,967 issued to Johnson et al discloses a system for delivering semi-fixed rounds of ammunition from a magazine to the breech of a large caliber gun movable in azimuth and elevation. The magazine includes drum type holders for projectiles and propellant charges which deliver both a projectile and a propellant charge together to a lower hoist. The lower hoist lifts the round to a movable carrier. The carrier is caused to rotate about the gun azimuth axis and to deliver the round to an upper hoist. The upper hoist rotates with the gun carriage and delivers the round to a swinging cradle which carries the round to a position where it is delivered to a transfer tray. The tray moves the round into axial alignment with the bore of the gun and a ram is utilized to insert the round into the gun breech.

An automated large caliber ammunition handling system is disclosed in co-pending continuation patent application Ser. No. 443,341 in which the prosecution is now closed and which is assigned to the Assignee of the invention disclosed herein. A cannon is mounted on a gun carriage and is free to move in elevation on the carriage about an elevation axis. The carriage is controlled in azimuth for gun pointing. A storage drum for holding a plurality of projectiles is mounted on one side of a vertical plane through the gun tube and another storage drum for holding a plurality of charges is mounted on the other side of the vertical plane. Both drums are mounted on the carriage and carry the projectiles and charges with their axes at substantially zero elevation. A projectile tray and a propellant charge tray are positioned to receive the projectiles and their propellant charges from the respective storage drums. The trays are pivotally mounted on cradle arms which move independently about the gun elevation axis on opposite sides of the gun so that the arms may be rotated between a receiving position and a gun loading position. The gun loading position is in alignment with the gun breech. A control is provided which actuates the mechanism components in sequence to transfer the projectiles and charges from the storage drums to the trays, to rotate the trays to the side independently, to rotate the cradle arms to the gun elevation independently, to rotate the trays into alignment with the breech independently and to ram the projectile and charge in sequence into the breech. The control monitors the positions of the system mechanical components and insures an appropriate operating sequence so that a series of ammunition rounds is delivered from the storage drums to the breech.

SUMMARY OF THE INVENTION

The invention disclosed herein relates to an automatic loading system for moving large caliber fixed ammunition within a turret which is rotatable about an azimuth axis relative to a turret support structure and wherein a gun barrel is mounted in the turret for movement in elevation relative thereto. An ammunition magazine is disposed in the turret and is rotatable about an axis substantially parallel to the azimuth axis. The magazine is annular in shape and has a plurality of ammunition holding cells therein. The cells are adapted to accommodate and retain fixed ammunition cartridges. Means is provided for angularly indexing the annular magazine to position predetermined ones of the holding cells at a load position. A loader arm is pivotally attached to the turret at one end. A ram tray assembly is pivotally mounted on the other end of the loader arm and is adapted to receive, engage and disengage fixed ammunition cartridges. Means is positioned on the loader arm for moving the ram tray assembly between the load position, wherein an ammunition cartridge may be moved between a holding cell and the tray, and an intermediate tray position. Means is attached to the turret for rotating the loader arm to move the ram tray assembly between the intermediate position and a ram position aligned with the breech of the gun when the gun is at an arbitrary elevation relative to the turret. Further means is provided for moving the ammunition cartridges into and out of the ram tray together with means for receiving from the breech and for discharging spent cartridge stub cases. Means is also provided for controlling actuation of the means for indexing, means for moving the ram tray, means for rotating the loader arm, means for moving ammunition cartridges and means for receiving and discharging spent stub cases in appropriate sequence to operate the system in a preselected mode.

BRIEF DESCRIPTION OF THE DRAWINGS

FIG. 9 is a side elevation view of the ram tray assembly of the automatic loading system.

FIG. 19 is a detail perspective view of the lower cartridge clamps in the magazine of the automatic loading system.

FIG. 23 is a block diagram of the control function included in the automatic loading system.

DESCRIPTION OF THE PREFERRED EMBODIMENT

Figure 1:
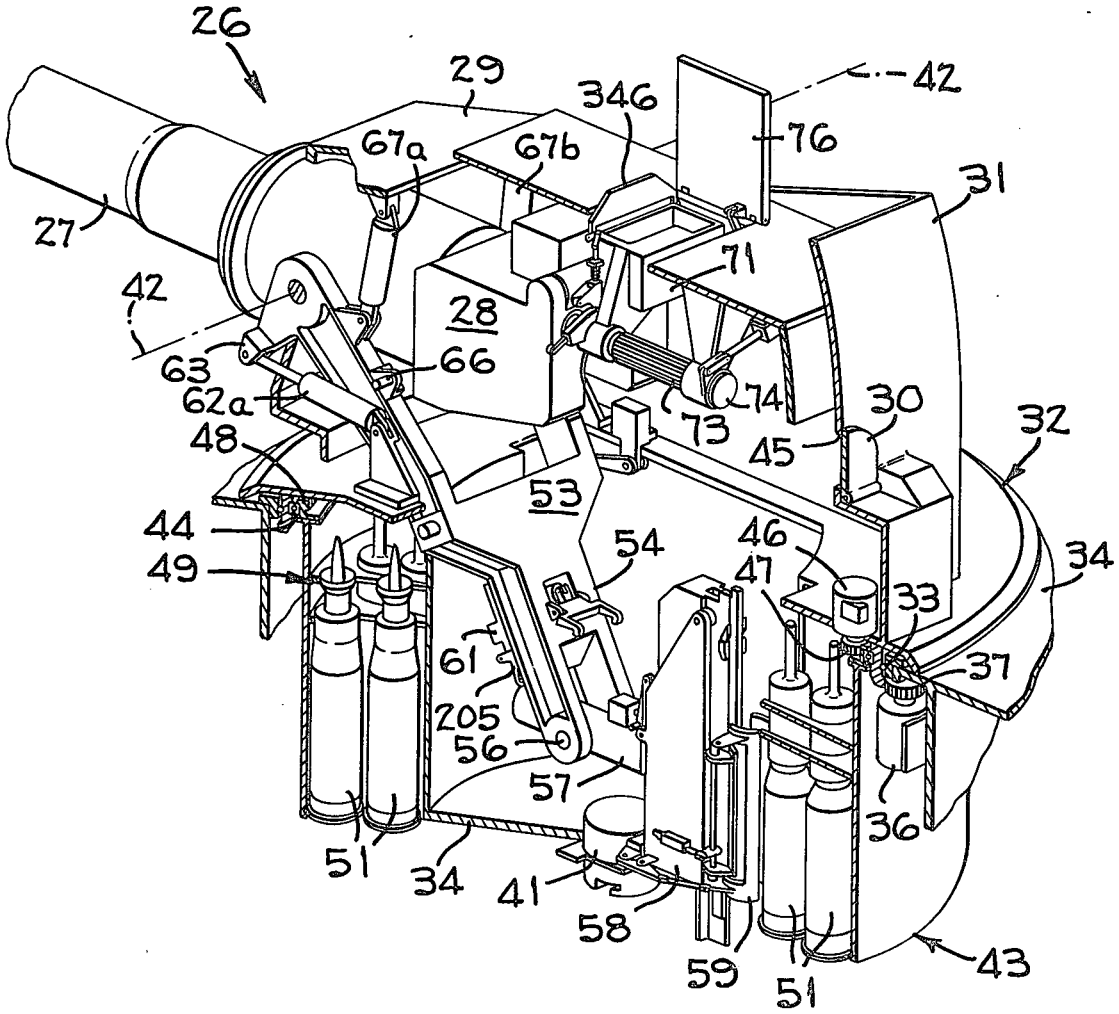
FIG. 1 is a perspective view partially broken away of the automatic loading system of the present invention.
Figure 2:
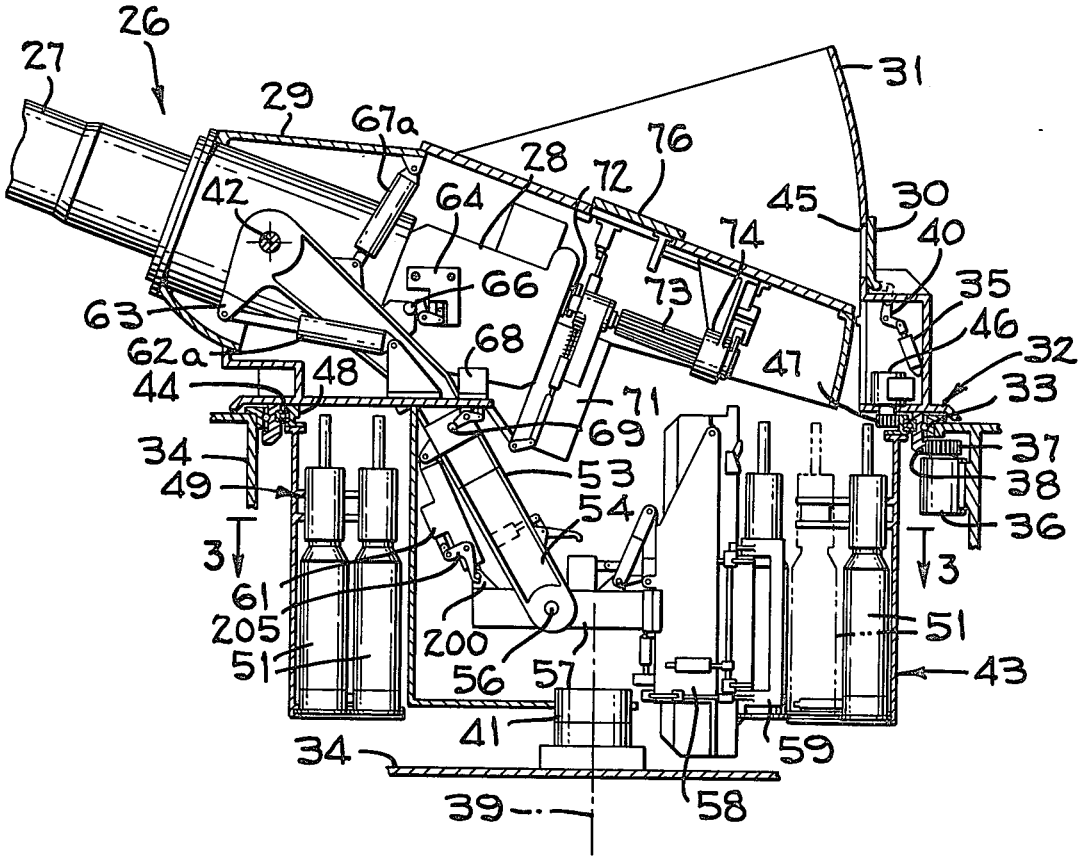
FIG. 2 is a side elevation view partially in section of the automatic loading system of the present invention.

In FIGS. 1 and 2 a perspective cutaway view and a side elevation section view are shown respectively of the automatic loading system for a cannon shown generally at 26 having a gun tube or barrel 27 and a breech portion 28. As seen in the Figures a mantlet 29 is attached to and moves with the cannon and a complementary gun enclosure structure 31 is provided as a part of a turret structure 32. The turret is supported on a turret bearing 33 which extends around the turret and which is disposed between the turret and turret supporting structure 34. A turret drive motor 36 is mounted to the support structure having a driven gear 37 thereon which is meshed with a turret mounted ring gear 38. The turret is therefore driven in azimuth about a substantially vertical azimuth axis 39 (FIG. 2) which passes through a conventional slip ring assembly 41. The slip ring assembly transfers hydraulic and electrical power from the turret support structure 34 to the various portions of the turret 32 and the disclosed automatic loading system which is completely contained therein. The cannon 26 and its component parts are driven in elevation about trunnions defining an elevation axis shown at 42 by hydraulic drive cylinders. The nature and location of the elevation hydraulic drivers are familiar to those of skill in this art and will therefore not be shown or described further in this disclosure.

A loading door 30 is positioned in the gun enclosure 31 at a point immediately behind the gun breech 28 when the gun tube is at zero elevation. A door actuator 35 is attached to the gun enclosure structure operating to open and close the door through appropriate linkage seen as item 40. The door is hinged to the gun enclosure to move between positions obstructing and clearing a loading hatch 45 in the gun enclosure.

An ammunition carousel or magazine 43 is situated below the cannon 26 and has an annular shape, as best seen with reference to FIG. 3. The magazine is supported for rotation within the turret 32 on a ring bearing 44 (FIGS. 1 and 2). The turret 32 has mounted thereon a magazine index drive motor 46 having a shaft extending therefrom with an index drive gear 47 attached thereto. The index drive gear is meshed with a magazine mounted ring gear 48 having internally projecting gear teeth as seen in FIGS. 1 and 2. The magazine 43 is thereby rotatable about the azimuth axis 39 by means of the index drive motor 46.

The magazine 43 has a plurality of cartridge storage cells spaced about the periphery of the magazine arranged in a pattern of inner ring storage cells **49*a* and outer ring storage cells 49*b*. The storage cells in this embodiment are spaced at angular increments of fifteen degrees, thereby providing for twenty-four cells in each of the inner and outer rings for a total of forty-eight storage positions for fixed ammunition cartridges indicated at 51. Each set of two adjacent storage cells 49*a* and 49*b* has been termed a storage stack assigned item number 49. The storage stack which is intersected by the vertical plane through the axis of the cannon 26 and situated behind the breech 28 is defined as occupying a load position 52 (FIG. 3**).

A loader arm 53 is pivotally attached to the trunnions on cannon 26 so that it may rotate about the elevation axis 42. The loader arm may be seen to be a "Y" shaped member (FIG. 1) having a clevis 54 at the lower end thereof. The clevis accepts projecting pivots 56 which extend from opposite sides of telescoping arm 57. The telescoping arm is shown in the retracted condition in FIGS. 1, 2 and 3. One end of the telescoping arm has a ram tray assembly 58 attached thereto which is extendable on the arm to place the tray within either the inner ring storage cell **49*b* or the outer ring storage cell 49*a* of the storage stack 49 at the loading position 52. The ram tray assembly includes clamp structure 59 which is adapted to engage the ammunition cartridges 51**.

Figure 3:
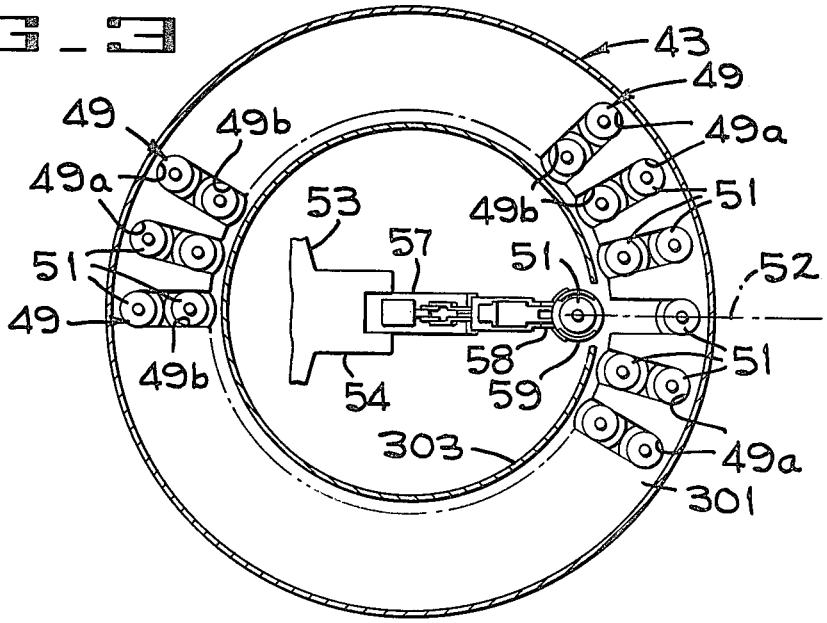
FIG. 3 is a section view along the line 3—3 of FIG. 2.

As seen in FIGS. 2 and 3 the ram tray assembly 58 may be moved translationally by the telescoping arm 57 between a magazine position shown in the Figures and the inner and outer storage shells of the storage stack 49 which is in line with the loading position 52. A rotational actuating cylinder 61 for the telescoping arm 57 is best seen in FIG. 2 and is pivotally attached at one end to the loader arm 53. The actuating cylinder has an extending rod which is attached to one end of the telescoping arm as shown to thereby rotate the arm and the attached ram tray assembly 58 into an intermediate position when extended.

The loader arm 53 has an arm raising actuator 62*a* which extends between the turret structure 32 and a projecting lever portion 63 on the loader arm. A similar actuator 62*b* is present on the other side of the arm. A loader arm to mantlet latch 64 (load arm raised) is shown in FIG. 2 only, because it is attached to the inside surface of the vertical wall portion of the mantlet 29. The latch is engaged by a pin 66 affixed to the loader arm so that the loader arm will be latched in the raised position. It should be noted that the ram tray assembly 58 must be rotated to the intermediate position by the rotational actuating cylinder 61 before the loader arm may be raised by the actuators 62*a* and 62*b* into a ram position behind the breech 28. Further, it is required that the inner storage cell 49*b* at the load position 52 for the magazine 43 be empty before the ram tray assembly 58 may be raised to the intermediate position since part of the ram tray assembly structure passes through the space within the inner ring storage cell 49*b* at the load position.

A pair of load arm lowering actuating cylinders 67*a* and 67*b* are disposed one on each side of the cannon 26 as shown in FIG. 1. The load arm lowering actuators extend between a pivotal connection to the mantlet 29 and a pivotal connection on the loader arm 53. A load arm lowered or load arm to turret latch 68 is shown attached to the turret structure 32. The latch engages a pin 69 on the loader arm to retain the arm in the lowered position. A similar latch and pin are disposed on the other side of the cannon as will be subsequently disclosed. Additional latches for the ram tray assembly 58 in the magazine position and the intermediate position will also be described in greater detail hereinafter together with the specific mechanical and hydraulic components to which they apply.

A spent cartridge stub case receiving container 71 is shown attached to the rear surface of the breech 28 in FIGS. 1 and 2. The stub case container has a forward extending door which clears through the bottom loading breech aperture seen in FIG. 1. The container is pivoted about a stub shaft 72 extending from the breech and is driven by a splined shaft 73 coaxial with the shaft 72. The splined shaft is configured to slide axially with the recoil of the breech through a driving member 74 which drives the container rotationally and also opens a stub case ejection door 76 in the mantlet 29 through which the stub case is thrown by the rotating container in a manner to be hereinafter described. The stub case ejection drive mechanism is mounted on the inside surface of the mantlet 29.

Figure 4:
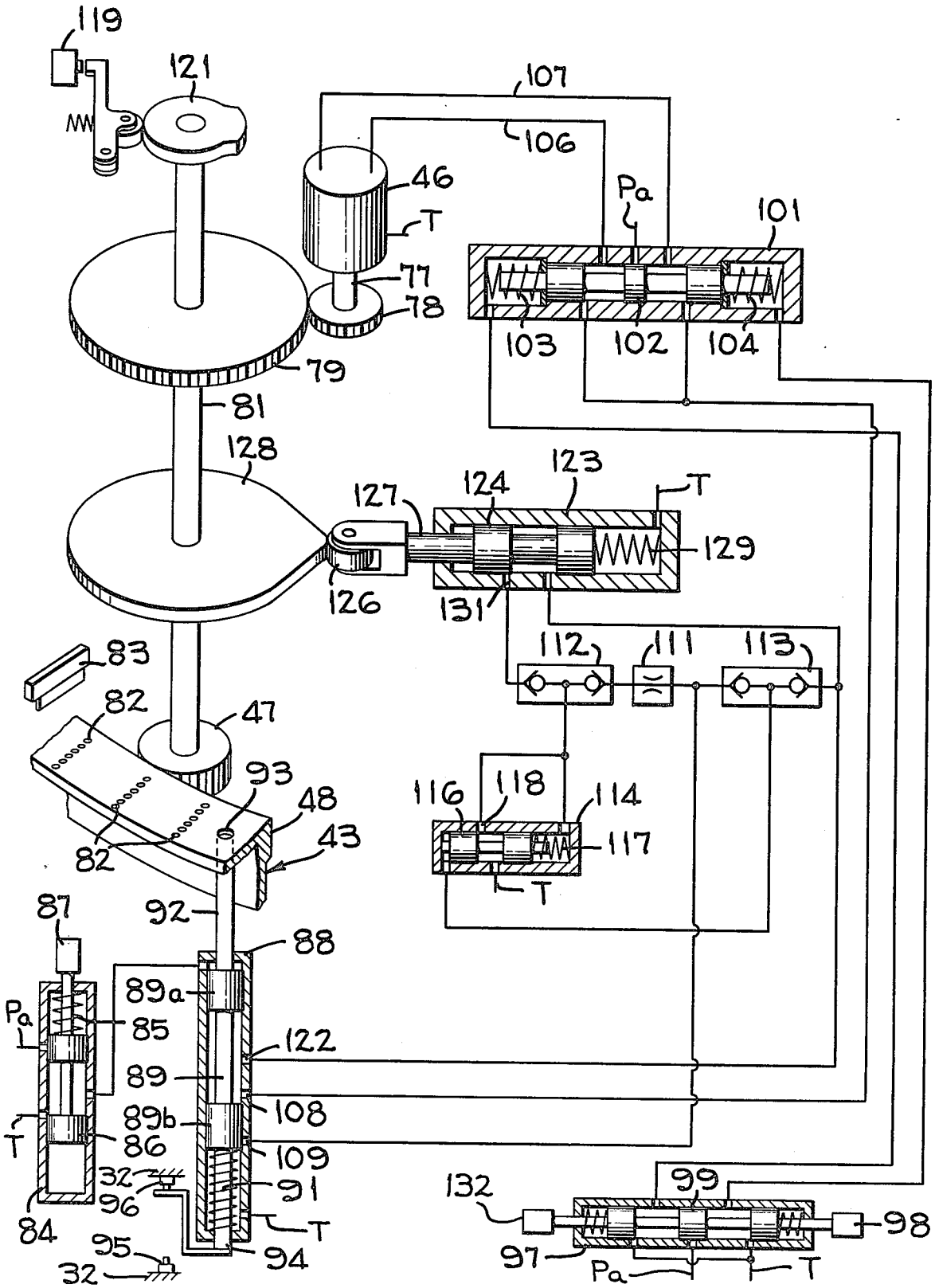
FIG. 4 is a hydraulic and mechanical schematic of the magazine index drive of the automatic loading system.

With reference now to FIG. 4 the manner in which the magazine 43 is indexed to bring predetermined storage stacks 49 to the load position 52 will be described. The index drive motor 46 is a hydraulic motor and has a shaft 77 extending therefrom on which is fixed a gear 78. This last named gear is meshed with a gear 79 on a shaft 81. The shaft 81 has fixed to the lower end thereof, as seen in FIG. 4, the index drive gear 47 which engages the magazine mounted ring gear 48. The gear ratios between the index drive gear and the magazine mounted ring gear are such that one complete revolution of the index drive gear produces one twenty-fourth of a revolution (15°) in the magazine mounted ring gear. It may be seen that a series of magnet arrays 82 are spaced about the magazine at angular increments equivalent to the angular spacing between the centers of the storage cell stacks 49 (15°). An array of magnetic sensing switches 83 are located at the load position 52 for the magazine so that the storage stack at the loading position is identifiable. Each magnet array has a different series of six magnet positions wherein magnets may be present or missing (binary) and each array therefore provides positive identification of the stack at the loading station through the sensing switches 83.

The magazine index drive mechanism is designed for two modes of operation, single step indexing and multiple step indexing. The decision as to which mode to enter is made by a system control to be hereinafter described. Operation of the index drive is initiated at a magazine latch retract pilot valve 84. The pilot valve has a piston 86 therein which is spring loaded by a compression spring 85 to a position which blocks the communication of hydraulic pressure Pa therethrough. When a solenoid 87 associated with the pilot valve is energized, the piston is raised against the force exerted by the compression spring, the tank port, T, is blocked by the piston 86 and pressure is communicated through the valve to the upper end of a magazine latch actuator 88. A piston 89 within the latch actuator is thereby driven through a full stroke (downwardly in FIG. 4) against the force exerted by an internal compression spring 91. The piston has two lands thereon, the upper one of which is designated 89*a* and the lower one of which is designated 89*b*. A latch member 92 extends from the upper end of the piston 89 through the wall of the actuator 88 and is formed to enter a latching hole 93 in the magazine 43, one of which is provided for each magazine index position, but only one of which is shown in FIG. 4. Another extension 94 from the piston 89 passes through the lower wall of the latch actuator 88 and serves to actuate a switch 96 attached to the turret 32. The switch provides a signal indication of the latch member condition as either engaged in a hole 93, and therefore in a latch condition, or in an unlatched condition.

With the latch actuator piston 89 fully retracted (shown in FIG. 4) another switch 95 is actuated to provide an indication of such full retraction. When the control system then provides a signal to the index drive pilot valve requiring rotation of the magazine 43 in a counterclockwise direction, for example, as seen in FIG. 4, a solenoid 98 is energized causing a piston 99 within a pilot valve 97 to translate to the right as seen in the Figure. Pressure is thereby communicated from the center port at one side of the pilot valve to the left port on the other side of the valve, and from there into the left end of a motor transfer valve 101. The transfer valve includes a piston 102 which is spring loaded to a neutral position within the valve body by a compression spring 103 at one end and a similar compression spring 104 at the opposite end. The pressure introduced into the left end of the valve 101 causes the piston 102 to translate to the right against the force exerted by the compression spring 104 to thereby communicate pressure through the transfer valve to an input/output line 106 on the hydraulic motor 46. This introduction of pressure, for purposes of this description, will be described as driving the shaft 77 in a clockwise direction as seen in FIG. 4, and the hydraulic return will pass through an input/output line 107 on the hydraulic motor. The gear 79 is therefore seen to be driven in a counterclockwise direction together with the shaft 81 and the index drive gear 47. This imparts a counterclockwise rotation to the ring gear 48 and therefore the magazine 43 as viewed in FIG. 4. The hydraulic return from the motor 46 through the input/output line 107 is passed through the valve 101 to a port 108 in the magazine latch actuator 88. With the piston 89 in the fully retracted position, the only other port in the latch actuator unobstructed by either of the piston lands 89*a* or 89*b* is a port 109. Return hydraulic pressure is therefore directed through the magazine latch actuator 88 to one side of an orifice 111 and through a pair of check valves 112 and 113. Check valve 113 places the return line pressure at the left end of a pressure compensation valve 114 which is therefore exerted against the face of a contained piston 116. The piston is urged toward the left end of the pressure compensation valve by an internal compression spring 117. The orifice upstream pressure (through check valve 113) therefore urges the piston 116 to the right within the compensation valve. Orifice downstream pressure (through the check valve 112) urges the piston 116 to the left. As a consequence, a large pressure drop across the orifice 111 will cause the return path to the tank through the compensation valve 114 to be restricted as the piston 116 moves to the right in FIG. 4, thereby partially closing off an input port 118 to the valve. The pressure compensation valve therefore maintains a constant pressure across the orifice 111 which in turn gives a constant flow rate in the return line regardless of hydraulic pressure variations within the system.

As may be seen in FIG. 4 when the shaft 81 has been rotated one-half revolution, a switch 119 is actuated by a switch cam 121 fixed to the end of the shaft. If the control requires the magazine 43 to be incremented one storage stack increment (15°) only, actuation of the switch 119 after one-half revolution removes the actuation signal from the solenoid 87 for the magazine latch retract pilot valve 84 and the compression spring 85 returns the piston 86 to the position shown in FIG. 4 thereby blocking communication of pressure Pa through the pilot valve to the magazine latch actuator 88. The spring 91 in the latch actuator returns the piston 89 upwardly within the actuator as seen in the Figure until the latching member 92 rides on a surface of the magazine between the latching holes 93. Switch 95 assumes a state which indicates departure from the fully retracted condition for piston 89. This position for the magazine latch piston 89 is termed the half retract position and is maintained until the next latching hole 93 passes the end of the latch member 92, whereupon the latch member is forced into the latch hole to arrest the rotation of the magazine 43 at that position. In the interim, before a latch hole 93 is aligned with the latch member 92, the piston land 89*a* is positioned within the latch actuator 88 to leave an actuator port 122 unobstructed. Concurrently the piston land 89*b* is positioned to obstruct the actuator port 109. Therefore, the return path for hydraulic pressure through the magazine latch actuator is by way of the port 108 and the port 122. This communicates pressure to a deceleration valve 123 which has a piston 124 therein which is moved within the valve by a cam follower 126 attached to a member 127 extending through the wall of the valve. The cam follower is urged into contact with a cam 128 by a compression spring 129 which exerts a force against the end of the piston 124. The cam 128 is fixed to rotate with the shaft 81 so that when the magazine latch retract pilot valve 84 is de-energized and the hydraulic return path passes through the deceleration valve 123 as described, the cam 128 after one full turn of the shaft 81 will move the piston 124 to the right in the deceleration valve 123 against the compression spring 129, as shown, and a port 131 in the deceleration valve and in the hydraulic return path will gradually be positioned to a fully closed condition after one full turn of the shaft 81. At this point the magazine latch member 92 falls into the aligned latch hole 93 in the magazine physically holding it at the desired location. After the piston 89 in the magazine latch actuator 88 is fully extended, the control system deenergizes the solenoid 98 thereby blocking pressure at the pilot valve 97, thus preventing any pressure from reaching the transfer valve 101 and the motor 46. It should be noted that in multiple step indexing the magazine latch retract pilot valve 84 is held in the energized state by a continuing signal to the solenoid 87 until one-half revolution before the desired magazine indexed position is reached. This keeps the return from the motor 46 flowing through the orifice 111 to the return tank, thereby maintaining a constant maximum speed until such time as deceleration is implemented by means of the deceleration valve 123 as hereinbefore described. It should also be noted that for driving the magazine 43 in a clockwise direction as seen in FIG. 4 a solenoid 132 on the index drive pilot valve 97 will be energized by the control system, thereby shifting the appropriate valves to drive the motor 46 in an opposite direction.

Figure 5:
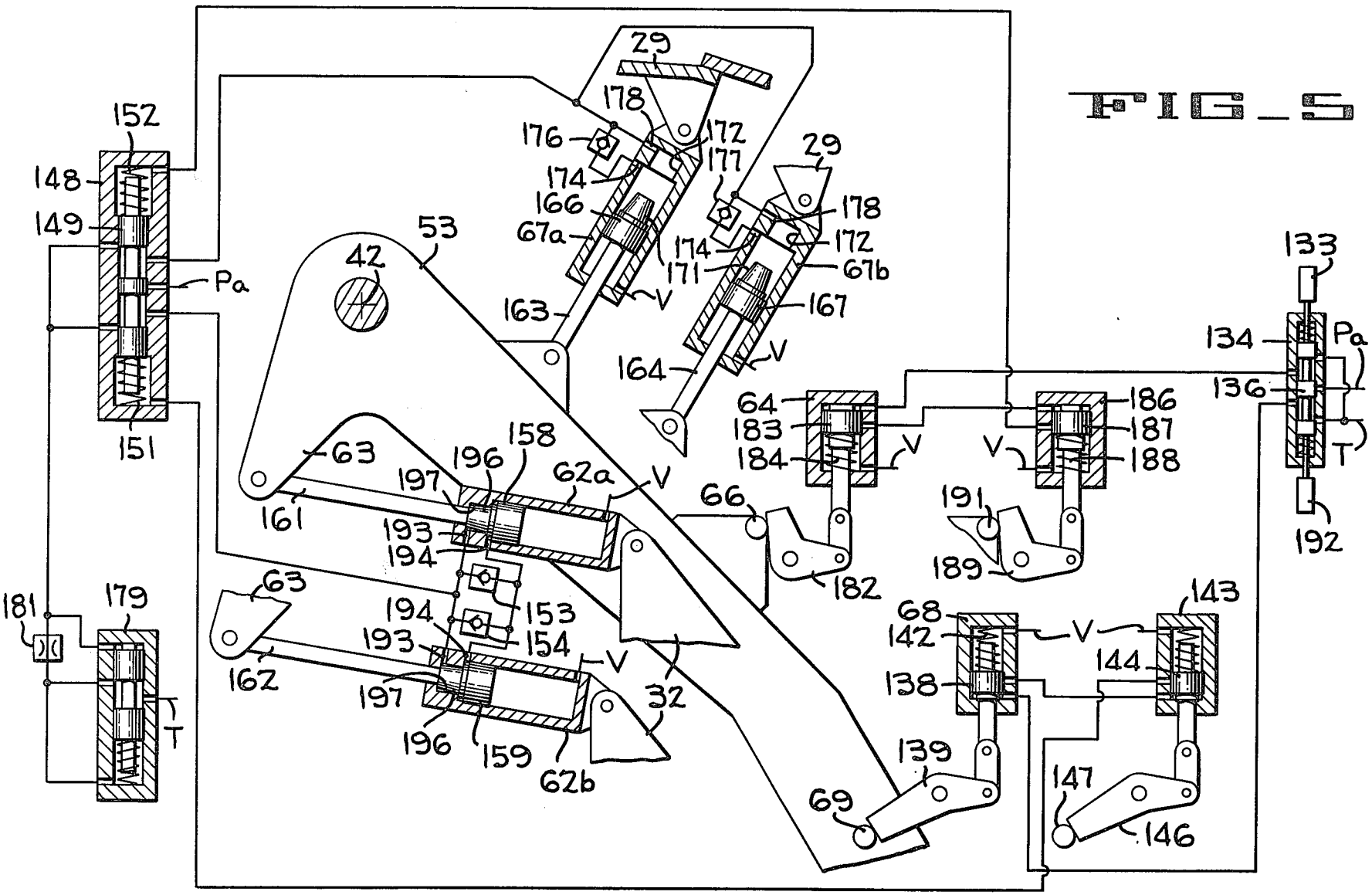
FIG. 5 is a hydraulic and mechanical schematic of the loader arm drive of the automatic loading system.

With reference now to FIG. 5 of the drawings, an explanation of the operation of the loader arm 53 will be undertaken while referring to the mechanical and hydraulic schematic contained therein. The loader arm is pivotally mounted on the turret to rotate about the elevation axis 42 which passes through the trunnions for the cannon 26 as mentioned hereinbefore. As shown in FIG. 5 the loader arm is in the lowered position. As mentioned hereinbefore the loader arm has a fork like or "Y" configuration wherein the upper portion extends on either side of the cannon 26 to engage the trunnions at the elevation axis. Consequently, the actuating cylinders and latches in FIG. 5 appear in pairs.

When the control portion of the system requires that the loader arm be brought to the raised position from that shown in FIG. 5, a solenoid 133 on a loader arm pilot valve 134 is energized causing a piston 136 within the pilot valve to move upwardly as depicted in the pilot valve. Pressure, Pa, from a hydraulic source is communicated through the pilot valve to the lower end of the lowered loader arm latch 68 which has a piston 138 therein coupled to a bell crank 139. The bell crank captures the pin 69 on the loader arm to maintain the arm in the lowered position. The piston is therefore moved upwardly within the latch 68 against the force of a compression spring 142. This piston motion opens a path through the latch 68 to the lower end of an additional lowered load arm latch 143. A piston 144 is disposed within the latch 143 and the piston is coupled to an additional bell crank 146 which bears against a pin 147 located on the other branch of the forked portion of the loader arm in a fashion similar to that described in conjunction with bell crank 139 and loader arm mounted pin 69. The piston 144 rises in the latch 143 thereby unblocking a port in the latch which communicates the pressure to the lower end of a loader arm transfer valve 148. The transfer valve has a piston 149 therein which is urged to an intermediate position within the valve by a compression spring 151 bearing against one end of the piston and a compression spring 152 bearing against the opposite end of the piston. The piston is raised (from the position seen in FIG. 5) against the force exerted by the compression spring 152 thereby communicating pressure through the transfer valve and through a pair of check valves 153 and 154 to the left ends of the loader arm raising cylinder 62*a* and another loader arm raising cylinder 62*b* on the opposite side of the cannon. The two loader arm raising cylinders are pivotally attached to the turret structure 32 as shown. Contained within the raising cylinders 62*a* and 62*b* are pistons 158 and 159 respectively. A rod 161 extends from the piston 158 and a rod 162 extends from the piston 159. Each rod is pivotally attached to the end of the lever projection 63 on the bifurcated upper portion of the loader arm 53. As a result, the two loader arm raising cylinders extend between the turret structure and the lever 63 on the loader arm structure. Since actuation of the loader arm pilot valve 134 releases the bell crank latch members 139 and 146 from the opposite side latch pins 69 and 147 respectively on the loader arm, the pressure at the left ends of the raising cylinders causes the rods 161 and 163 to retract and the loader arm 53 to therefore move in a counterclockwise or raised sense about the elevation axis 42.

While the loader arm 53 is being raised about the elevation axis 42 by the load arm raise cylinders 62*a* and 62*b*, a pair of rods 163 and 164, which are pivotally attached to the loader arm, are also seen to be moved in a generally upward direction as seen in FIG. 5. The rods 163 and 164 are attached to pistons 166 and 167 respectively which are disposed for movement along the inside of the previously mentioned pair of loader arm lowering cylinders 67*a* and 67*b* respectively. The upper ends of the load arm lowering cylinders are pivotally attached to the mantlet 29. The lowering cylinders may therefore be seen to provide an expandable and retractable link between the mantlet 29 and the loader arm 53. As the loader arm continues to be raised through the action of the raising cylinders 62*a* and 62*b*, a slightly tapered deceleration choke sleeve 171 on the end of each of the pistons 166 and 167 is seen in enter a cylindrical cavity 172 at the upper end of each of the lowering cylinders 67*a* and 67*b*. Ports 174 in the lowering cylinders are coupled to lines blocked by a pair of check valves 176 and 177. It may be seen therefore that the only passage in the lowering cylinders through which hydraulic fluid may escape are the ports 178 at the ends of the cavities 172. These last named ports are gradually shut off as the conical choke sleeves enter into their respective cylindrical cavities, so that the raising of the loader arm 53 is stopped at a specific position with relation to the mantlet 29. Since the mantlet 29 is attached to and moves with the cannon 26, the raised stop position are seen to be set to provide that the loader arm positions the ram tray assembly 58 in alignment with the breech 28 so that a round carried in the ram tray may conveniently be rammed into the breech.

The hydraulic fluid being expelled from the lowering cylinders 67*a* and 67*b* in FIG. 5 is routed through the transfer valve 148 with the piston 149 raised therein. Thus, the fluid is directed through a pressure compensation valve 179 which functions in conjunction with an orifice 181 to maintain constant pressure in the return line to the tank, T, in the same fashion as the orifice 111 and the pressure compensation valve 114 of FIG. 4 perform such a function. When the loader arm has reached the raised position, the loader arm raised latch 64 described hereinbefore latches the loader arm in the raised position when the latch pin 66 cams a bell crank 182 out-of-the-way as the arm is raised. The loader arm up latch 64 is attached to the inside of the mantlet 29 and contains a piston 183 therein which is spring loaded by a compression spring 184 toward the upper end of the piston travel. The piston is vented, as shown at V, and is coupled to the bell crank 182 so that when the pin 66 cams the bell crank 182 out-of-the-way the piston 183 is drawn downwardly within the latch against the force of the spring 184. A similar up latch 186 is disposed on the other side of the loader arm also having a piston 187 urged toward the upper end of the latch by a compression spring 188. The piston is connected to a bell crank 189 and functions in association with a pin 191 on the other side of the loader arm in the same fashion as the up latch assembly described in connection with the latch 64. The loader arm is therefore stopped in a predetermined position relative to the mantlet 29.

It may be seen that by energizing a solenoid 192 associated with the loader arm pilot valve 134, that the cylinder 136 will be drawn downward within the pilot valve thereby communicating pressure Pa to the upper end of the loader arm uplatch (or loader arm to mantlet latch) 64, depressing the piston 183 therein and disengaging the bell crank 182 from the up latch pin 66. Pressure is thereby communicated through the up latch 64 to the upper side of the piston 187 in the uplatch 186 on the opposite side of the loader arm. In like fashion this latter cylinder is moved downwardly thereby disengaging the bell crank 189 from the up latch pin 191. Pressure is communicated through the up latch 186 to the upper end of the transfer valve 148 causing the piston therein to be lowered as seen in FIG. 5. Thus, pressure is communicated through the transfer valve to the upper ends of the loader arm lowering cylinders 67*a* and 67*b* forcing the pistons 166 and 167 therein downwardly to thereby lower the now unlatched loader arm.

Lowering of the loader arm 53 may be seen in FIG. 5 to cause the pistons 158 and 159 in the loader arm raising cylinders 62*a* and 62*b* to be moved toward the left end of their respective cylinders as the lever portions 63 on the loader arm cause the rods 161 and 162 to be extended. The fluid escaping from the actuators 62*a* and 62*b* flows therefrom through ports 193 at the ends of the actuators. Ports 194 in the actuators may be seen to be blocked by the check valves 153 and 154. The pistons 158 and 159 have tapered deceleration choke sleeves 196 at one end similar to the sleeves 171 described in conjunction with pistons 166 and 167 in the lowering actuators 67*a* and 67*b*. The ends of the loader arm raising actuator cylinders have cylindrical cavities 197 similar to the cavities 172 described in conjunction with the loader arm lowering actuator cylinders 67*a* and 67*b*. In the same fashion as that described hereinbefore for positioning the loader arm in the raised position by means of the deceleration and stopping provided by the choke sleeves 171 and cavities 172 in the lowering actuators 67*a* and 67*b*, the choke sleeves 196 and cavities 197 in the raising actuators 62*a* and 62*b* decelerate and stop the loader arm at the lowered position with constant positional reference to the turret structure 32. The return fluid during lowering from the raising actuators is routed to tank through the pressure compensation valve and orifice 181 as hereinbefore described, which maintains a constant pressure in the return line. Thus, wherever the cannon 26 is positioned in elevation, the loader arm when raised is brought into a predetermined position relative to the cannon.

Figure 6:
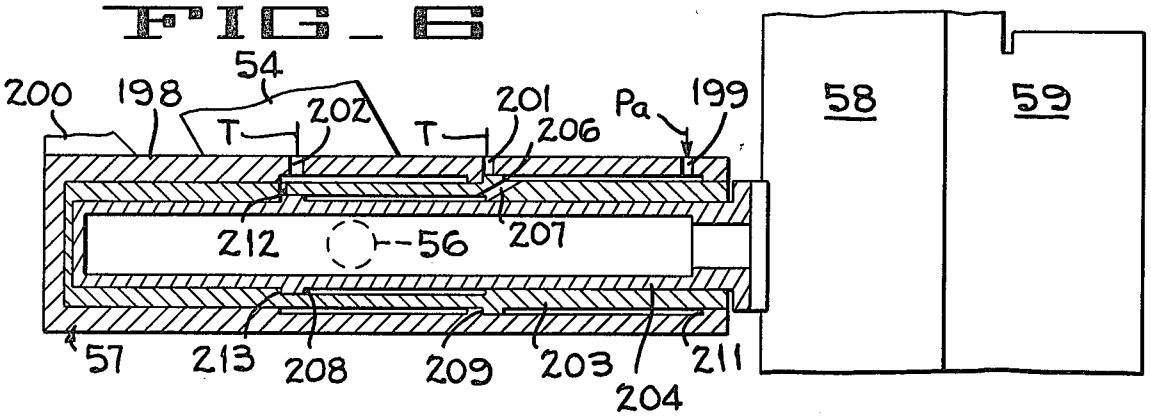
FIGS. 6, 7 and 8 are side elevation section views of the ram tray translation mechanism of the automatic loading system.
Figure 7:
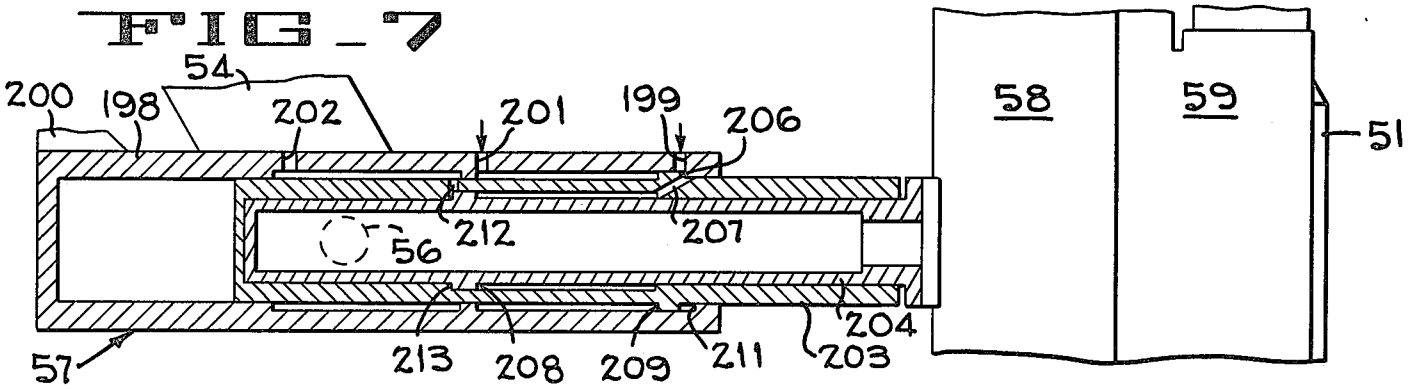

With reference now to FIG. 6 the clevis 54 at the free end of the loader arm 53 is shown together with the position of the pivotal projections 56 from the telescoping arm assembly 57. The telescoping arm has an outer sleeve 198 with three input ports 199, 201 and 202 therein. An intermediate sleeve 203 is disposed within the outer sleeve for axial movement relative thereto. An inner sleeve 204 is disposed within the intermediate sleeve and is free to move axially relative to the intermediate sleeve. The inner sleeve 204 has a free end to which is fixed the ram tray assembly 58. The telescoping arm in FIG. 6 is shown in the magazine position with the loader arm 53 lowered as hereinbefore described. With pressure Pa introduced to the port 199 and with ports 201 and 202 communicated to tank, T, a net force is exerted against a face 206 on the intermediate sleeve and is communicated through an aperture 207 to provide a net force against a face 208 on the inner sleeve. As a consequence, the intermediate and inner sleeves are retained in a retracted condition within the outer sleeve 198. When pressure is communicated to the port 199 and the port 201, it is also exerted against a face 209 on the intermediate sleeve 203. The face 209 is larger in area than the face 206 and therefore a net force driving the intermediate sleeve 203 toward an extended position relative to the outer sleeve 198 is provided so that the intermediate sleeve assumes the position seen in FIG. 7. The intermediate sleeve may be seen to carry the inner sleeve 204 with it in its extension and therefore the ram tray assembly 58 is moved translationally. The intermediate sleeve is stopped in its extension as the face 206 thereon contacts the face of an inwardly extending flange 211 at the end of the outer sleeve 198. Pressure is still communicated through the port 199 and the aperture 207 to appear at the face 208 on the inner sleeve 204. With the intermediate sleeve 203 extended as shown in FIG. 7, the ram tray assembly 58 is positioned so that the clamps 59 may engage a fixed ammunition cartridge 51 within a storage cell **49*b* in the inner ring of cells within the storage stack 49 at the load position 52 for the magazine 43**.

Figure 8:
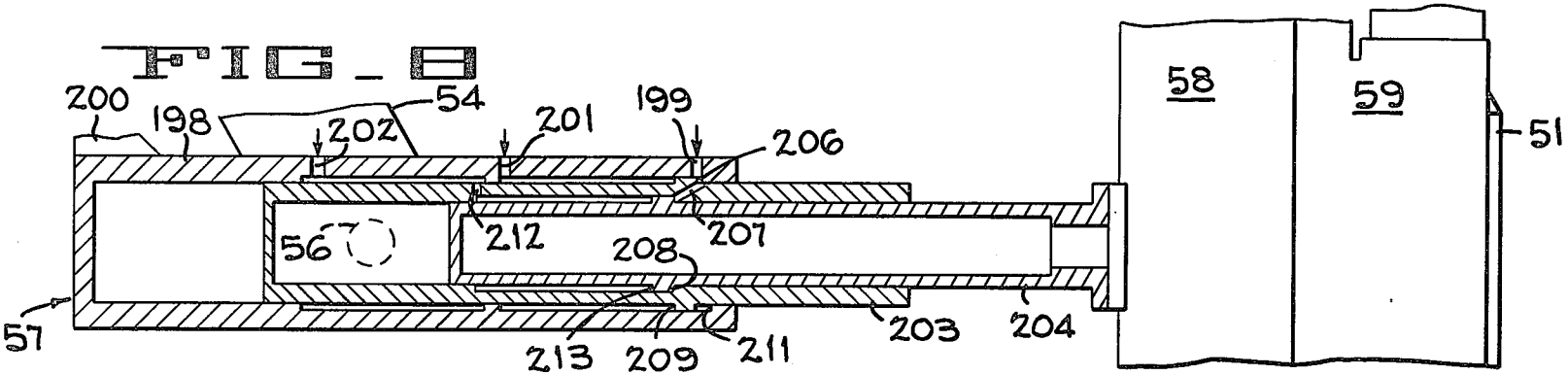
Figure 5:
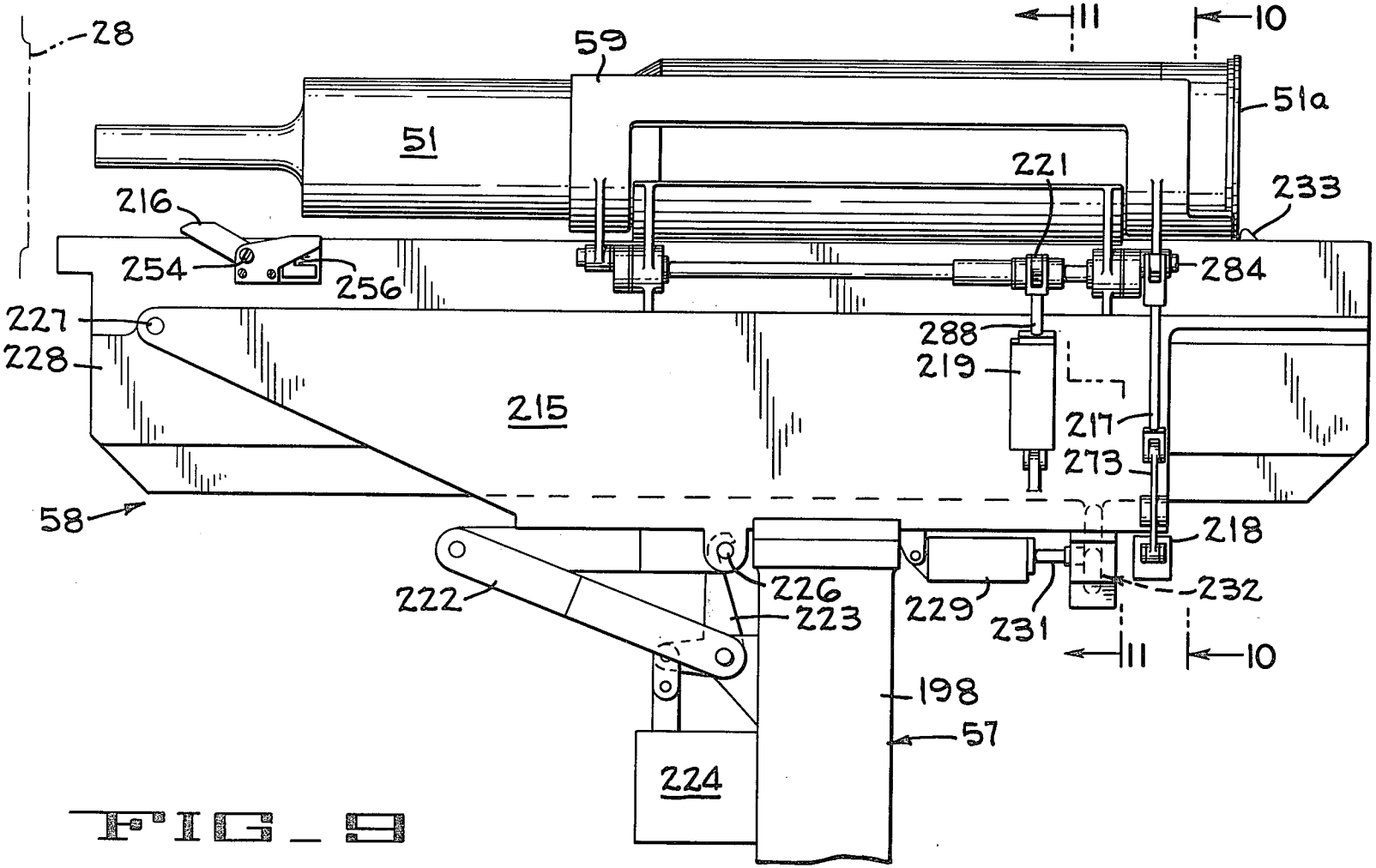

When pressure is introduced at the port 202 as well as at the ports 201 and 199, the pressure is communicated through an aperture 212 in the intermediate sleeve 203 to bear against a face 213 on the inner sleeve 204. The face 213 has a larger area than the opposing face 208 on the inner sleeve, and therefore the pressure Pa provides a net force causing the inner sleeve to move toward an extended position relative to the intermediate sleeve 203 as seen in FIG. 8. With both the inner and intermediate sleeves in the extended position of FIG. 8, the ram tray assembly 58 is disposed so that the clamps 59 thereon are positioned to engage a fixed ammunition cartridge 51 within the outer storage cell **49*a* in the storage stack 49 at the loading position 52 for the carousel 43. It may be seen that from the foregoing that pressure at port 199 only leaves the ram tray assembly 58 in the retracted magazine position and that provision of pressure at port 201 places the telescoping arm in a half extended position as seen in FIG. 7. Additionally, provision of pressure at port 202 causes the telescoping arm to fully extend thereby accessing the outer ring of storage cells 49*a*. The inner sleeve 204 is stopped in its axial extension by contact between the face 208 and an internal shoulder 214 on the intermediate sleeve 203. The aforedescribed telescoping arm positions are maintained as long as the pressures are maintained at the required ports in the telescoping arm. In like fashion, removal of pressure from port 202 and communication of the port to tank T will cause the inner sleeve 204 to retract to the position seen in FIG. 7 as the pressure on the inner sleeve face 208 is greater than that on the face 213 which is now communicated to the tank through the aperture 212 and the port 202. Further, communication of the port 201 with tank pressure T will reduce the pressure on the face 209 on the intermediate sleeve 203 and a net force retracting the inner sleeve to the position shown in FIG. 6 will be provided by the pressure through the port 199 bearing against the face 206** on the intermediate sleeve. Therefore pressure always positively positions the sleeves within the telescoping arm assembly relative to one another and also maintains that positioning as long as the pressure is applied.

The rotating actuator cylinder 61 (FIGS. 1 and 2) for the telescoping arm 57 is pivotally mounted at one end to the loader arm 53. A rod extends from the end of the actuator and is pivotally mounted to a tab 200 which is partially shown in FIGS. 6, 7 and 8. Extension of the rod, as seen with reference to FIG. 2, will clearly cause the telescoping arm assembly and the ram tray assembly 58 carried thereon to be rotated upwardly about the axis of the projections 56 into what is defined as an intermediate ram tray assembly position. Prior to extension of the rod from the actuator 61 a bell crank latch 205 is actuated to release the telescoping arm from the magazine position shown in FIG. 2 by mechanism similar to that shown for actuation of the bell crank latches in FIG. 5.

Turning now to FIG. 9 of the drawings, the ram tray assembly 58 is seen having a fixed ammunition cartridge 51 engaged thereon by the clamps 59. The view of FIG. 9 represents the ram tray assembly with an engaged cartridge in either the lowered magazine position (wherein the long axis of the cartridge is substantially vertical) or in the ram position behind the breech 28 of the cannon 26 (wherein the long axis of the cartridge is substantially coaxial with the breech axis). The ram tray assembly may be seen to include a framework 215, movable forward cartridge supports 216 and rearwardly located linkage 217 coupled to a clamp fully opening cylinder 218. Also included in the ram tray assembly is a clamp partially opening cylinder 219 together with linkage 221 coupling the last named cylinder to the clamps 59. The clamps are configured to contact the cartridge around its major diameter and to afford support therealong.

Anti-rotation linkage 222 is shown in a folded condition in FIG. 9 extending between the telescoping arm 57 and the framework 215 for the ram tray assembly. A magazine position latching bell crank 223 is pivotally attached to the outer sleeve 198 of the telescoping arm. The magazine position latch is attached at one end to linkage extending from a ram tray retracted latch 224. The latch 224 contains structure similar to that described for the load arm lowered latch 68 in conjunction with the description of FIG. 5. The other end of the bell crank latch member 223 has a hook formed thereon which engages a latching pin 226 attached to the framework 215 of the ram tray assembly 58. Prior to extension of the telescoping arm 57 the ram tray retract latch 224 is energized releasing the hooked end of the bell crank latching member 223 from the pin. The framework of the ram tray assembly is thereafter stabilized rotationally with respect to the telescoping arm 57 by the anti-rotation linkage 222.

Pivotally mounted within the framework 215 of the ram tray assembly 58 at a pivot point 227, is a ram drive assembly 228. The ram drive assembly will be described with reference to FIGS. 10 through 14 hereinafter. It is sufficient at this point to note that a ram drive assembly pivoting actuator 229 is mounted on the ram tray assembly framework 215 having a piston contained therein and an attached rod 231 extending therefrom. The free end of the rod is attached to a linkage 232 affixed to the ram drive assembly 228 for a purpose to be hereinafter described.

Figure 13:
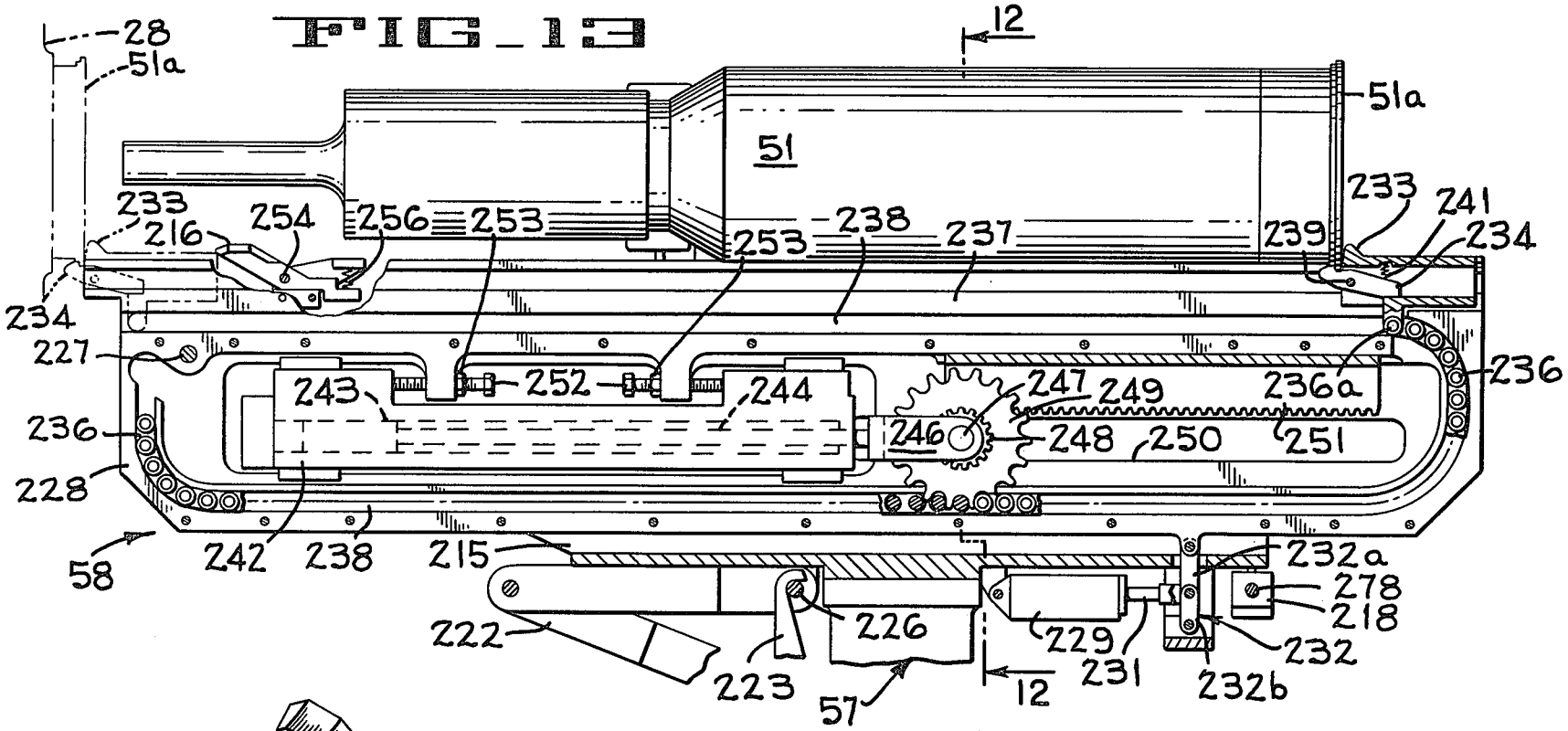
FIG. 13 is a side elevation view partly in section of the ram tray assembly of the automatic loading system.
Figure 15:
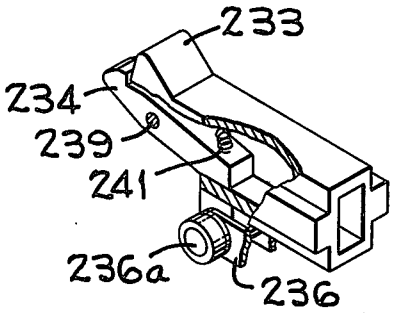
FIG. 15 is a perspective view of a ram pawl and ram latch assembly in the ram tray assembly of FIG. 13.

Turning now to FIG. 13 a description will be provided for the ram drive assembly 228 included in the ram tray assembly 58. As mentioned hereinbefore, the ram drive assembly is pivotally mounted within the framework 215 for the ram tray assembly at a pivot 227. A ram pawl 233 and a ram latch 234 are seen to be pivotally attached to one end of a roller chain 236. The ram pawl is configured to slide in a ram pawl track 237 which is situated on the ram drive assembly immediately above and parallel to a roller chain track 238 which serves to guide the roller chain along the length of the ram drive assembly. The ram pawl shape is best seen in FIG. 15 wherein it is shown attached to the end link **236*a* in the roller chain 236. The ram latch is pivotally mounted within the ram pawl for rotation about a pin 239 extending therethrough. The ram latch is urged toward the forward face of the ram pawl by a compression spring 241 fixed between the pawl and the latch as seen in FIGS. 13 and 15. In this fashion the pawl and the latch may positively engage both the forward and rear faces of the rim of a stub case 51*a* on a fixed ammunition cartridge 51**.

The ram pawl and ram latch 233 and 234 are shown in FIG. 13 in the ram position. The pawl and latch are also shown in dashed lines in the extended position. The cartridge is thus restrained both fore and aft during all loading and unloading operations. When a cartridge is being unloaded from the breech or a misfired cartridge is being removed therefrom, the cartridge is partially urged from the breech by a breech extractor mechanism (not shown) to a position substantially as shown in dashed lines in FIG. 13. The ram latch 234 as it is being extended will be cammed out-of-the-way by the rim of the stub case **51*a* and will then be urged by the spring 241 to capture the rim between the latch and pawl. The cartridge may subsequently be withdrawn rearwardly along the ram tray assembly by retraction of the roller chain 236**.

When the system is required to extract a misfired ammunition cartridge from the breech, the cartridge is engaged as shown in dashed lines in FIG. 13 and as hereinbefore described and moved rapidly away from the breech by the engagement between the ram latch 234 and the rim of the cartridge stub case **51*a*. When the cartridge nears the end of its travel on the ram tray assembly, the ram drive assembly pivoting actuator 229 is energized to cause the rod 231 to be retracted therein. The linkage 232 to which the end of the rod is attached has an upper link 232*a* attached to the ram drive assembly 228 and a lower link 232*b* attached to the ram tray assembly framework 215. The retraction of the rod may be seen to draw the attachment points for the linkage on the ram drive assembly and the framework closer together. This causes the ram drive assembly to rotate downwardly about the pivot 227, thereby lowering the ram pawl 233 out of a position behind the rim of the stub case 51*a*. The inertia of the cartridge 51 will carry it off of the end of the ram tray assembly and through the aperture 45 (FIG. 2) which has been cleared by opening of the loading door 30 in synchronism with the misfired cartridge extraction. The misfire extraction is accomplished with the cannon 26 positioned at zero degrees elevation. It should be noted that when using the system to replenish the magazine 43 with cartridges, the ram pawl 233** is also depressed to an out-of-the-way position in the manner just described and the cannon is positioned at zero elevation.

A hydraulic drive cylinder 242 is fixed within the ram drive assembly 228 having a piston 243 shown in dashed lines therein which is disposed to be driven between the ends of the cylinder. The piston has a rod 244 attached thereto which extends from one end of the cylinder and which has a clevis 246 affixed to the end thereof. The clevis translates within a clevis guide 250 as it is driven back and forth in the ram drive assembly 228 by the rod 244. The clevis supports a rotating shaft 247 on bearings therein. A split pinion gear 248 and a sprocket 249 are attached to the shaft. The pinion is meshed with a rack 251 which is fixed within the ram drive assembly. The sprocket engages the roller links of the roller chain 236 as shown in FIG. 13 so that when the piston is driven to extend the rod 244 the pinion is rotated as it runs along the rack which thereby causes the sprocket on the pinion shaft to rotate counterclockwise as seen in FIG. 13. The sprocket therefore drives the roller chain in the roller chain track 238 to extend the ram pawl and latch 233 and 234, respectively. The ram pawl drive assembly 228 suffers from a severe length restriction and the necessary travel of the roller chain for obtaining the necessary ram pawl and latch excursion is obtained through the ratio between the pinion and the sprocket as well as the excursion of the pinion along the length of the rack. The roller chain and the ram pawl are thereby moved through about 40 inches of travel with less than a 13 inch piston stroke in the hydraulic cylinder 242. During assembly the longitudinal position of the hydraulic cylinder 242 within the ram drive assembly is adjustable by means of screws 252 and locknuts 253 so that the ram pawl 233 may be correctly positioned in the ram drive assembly.

Figure 14:
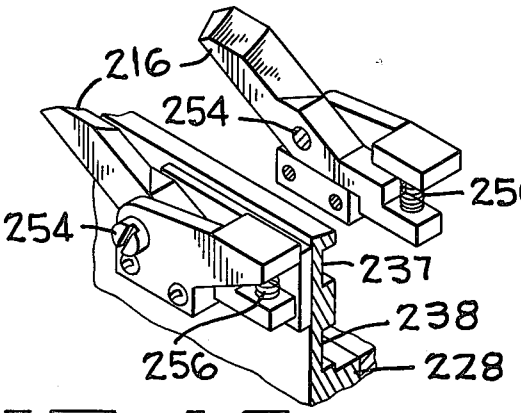
FIG. 14 is a detail of the forward cartridge supports in the ram tray assembly of FIG. 13.

When the cartridge clamps 59 in the ram tray assembly 58 are partially opened by means of the actuator 219 and the linkage 221, which will presently be described, in preparation for ramming a cartridge 51 into the breech 28, support for the cartridge as it moves forwardly from the clamps is provided by the aforementioned movable forward cartridge supports 216 which are best shown in FIG. 14. These forward supports are pivotally mounted to the ram drive assembly 228 by means of pins 254. The supports are urged upwardly as seen in FIGS. 13 and 14 about the pivots by means of coil springs 256 which are disposed between the ram drive assembly structure and one end of the forward support members. The projectile end of the cartridge will thus be maintained in a sufficiently elevated condition after it leaves the clamps 59 so that it may accurately be introduced into the breech by the action of the ram pawl 233.

Figure 16:
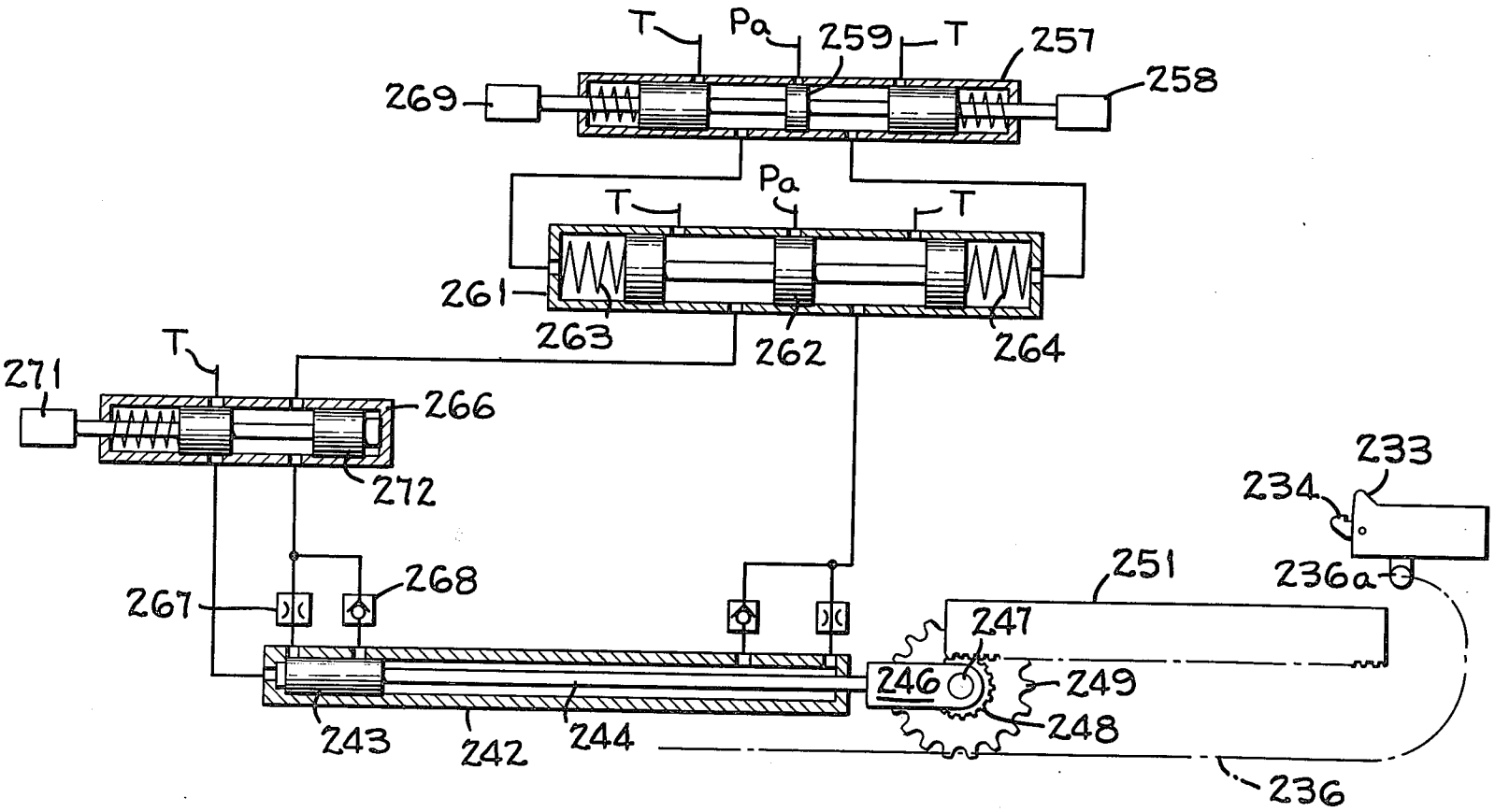
FIG. 16 is a mechanical and hydraulic schematic of the rammer drive in the ram tray assembly of FIGS. 9 and 13.

In FIG. 16 a hydraulic schematic is shown in conjunction with the hydraulic cylinder 242 and the piston 243 for the purpose of explaining the manner in which the ram drive assembly is actuated to ram and withdrawn ammunition cartridges. The rammer pawl is in the rammer or retracted position as shown in both FIGS. 13 and 16. A pilot valve 257 has a solenoid 258 associated therewith which when energized will cause a piston 259 within the valve to move toward the right end of the valve as seen in FIG. 16. Hydraulic pressure, Pa, will thereby be communicated through the pilot valve to the left end of a ram drive transfer valve 261. A piston 262 is held in a neutral position within the transfer valve by two compression springs 263 and 264. The pressure introduced to the transfer valve will cause the piston to translate to the right in FIG. 16 thereby communicating hydraulic pressure through a misfire selection valve 266, an orifice 267 and a check valve 268 into the left end of the hydraulic cylinder 242. The introduced pressure causes the piston 243 to translate to the right in the Figure thereby driving the rod 244 and the pinion and sprocket combination to provide movement of the roller chain 236 and extension of the ram pawl and latch as hereinbefore described.

When it is desired to retract the rammer pawl from the extended position a solenoid 269 associated with the pilot valve 257 is energized thereby moving the piston and the pilot valve to the left as seen in FIG. 16 and introducing pressure, Pa, to the right end of the ram drive transfer valve 261. The introduction of pressure into the transfer valve causes the piston 262 to translate to the left against the force exerted by the compression spring 263 so that hydraulic pressure will be introduced into the right end of the hydraulic cylinder 242. The piston will thereby be driven to the left within the hydraulic cylinder and fluid returned to tank from the left end of the cylinder through the orifice 267, the misfire selection valve 266 and the transfer valve 261. This provides a normal return for the ram pawl and latch from the extended position to the retracted or ram position. However, when a misfire is to be extracted from the breech, a greater retraction speed is desired to impart a greater momentum to the misfire cartridge being extracted so that it may be carried through the open loading hatch 45 as hereinbefore described. To accomplish the greater speed of retraction when the piston 243 is being returned from the right end of the hydraulic cylinder 242 toward the left end thereof, a solenoid 271 associated with a misfire selection valve 266 is energized causing a piston 272 within the valve to translate to the left as seen in FIG. 16 to thereby close off the path through the orifice 267 from the left end of the cylinder 242 and to provide a direct path from the cylinder through the misfire selection valve to tank T. This unrestricted path provides less resistance for the return of the piston 243 toward the left end of the hydraulic cylinder and therefore allows a higher speed for the pinion 248 along the rack 251 and a consequent higher retraction speed in the roller chain 236.

Figures 10, 11, 12:
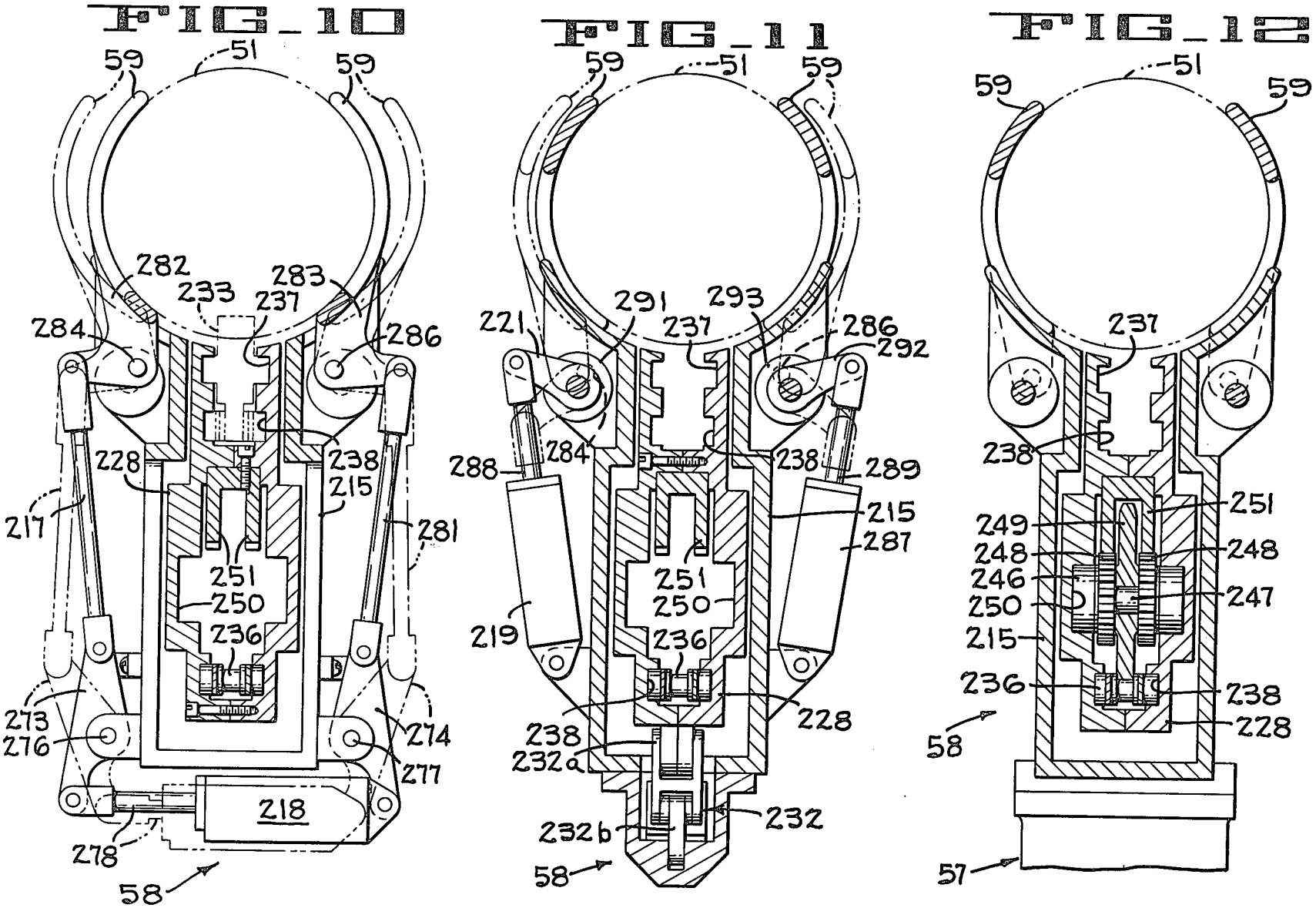
FIG. 10 is a section view taken along the line 10—10 of FIG. 9.
FIG. 11 is a section view taken along the line 11—11 of FIG. 9.
FIG. 12 is a section view taken along the line 12—12 of FIG. 13.

With reference now to FIGS. 10, 11 and 12 the ram drive assembly 228 is again shown as it appears within the ram tray assembly framework 215. The ram pawl track 237 may be seen to be disposed immediately above the roller chain track 238. The clevis guide 250 is readily seen as is the lower portion of the roller chain track 238 containing the roller chain 236. The rack 251 may be seen to be split so that the sprocket 249 may rotate between the spaced portions thereof. The split pinion 248 is best seen in FIG. 12 having the sprocket 249 disposed therebetween with both the pinion and sprocket fixed on the common shaft 247 which rotates in bearings in the clevis 246.

The cartridge clamps 59 are moved between the fully closed position seen in FIG. 12 and the fully opened position seen in FIG. 10 (dashed lines) by the hydraulic actuator 218 which floats between the ends of a left and right bell crank, 273 and 274 respectively, which are pivotally attached at pivot points 276 and 277 to the framework 215 for the ram tray assembly. Extension of a rod 278 emanating from the fully opening clamp actuator causes the bell cranks 273 and 274 to rotate about their respective pivot so that pivoting links 217 and 281 attached to the bell cranks are moved slightly upwardly as seen in dashed lines in FIG. 10. This causes an angular lever 282 attached to the end of rod 217 and another angular lever 283 attached to the end of a rod 281 to rotate toward one another about respective pivots 284 and 286. The cartridge clamps 59 thereby assume the position shown in solid lines in FIG. 10 in engagement with the outer surface of a cartridge 51. Retraction of the rod 278 by the clamp actuator 218 (as seen in dashed lines in FIG. 10) causes the bell cranks, rods and angular levers to undergo motion into the positions indicated by the dashed lines in FIG. 10, thereby causing the clamps 59 to open for the purpose of either releasing or preparing to engage an ammunition cartridge.

When a cartridge is engaged by the clamps 59 and is brought to the ramming position by rotation of the telescoping arm 57 and the loader arm 53, the clamps 59 must be partially opened so that during the ramming process the rim on the stub case 51*a* of the cartridge may pass the clamps as it is moved toward the breech by the rammer pawl 233. With reference to FIG. 11, a pair of partial clamp opening actuating cylinders 219 (as also seen in FIG. 9) and 287 are shown pivotally attached to the ram tray assembly framework 215. The partial clamp opening actuators have rods 288 and 289 extending from the upper ends thereof. The rod 288 is pivotally coupled to the linkage 221 first mentioned in conjunction with the description of FIG. 9, which is in turn fixed to a rotating member 291. The rotating member 291 has the pivot 284 mounted thereon in a position off of the center of the rotating member. With the rod 288 extended from the actuator 219 the center of rotation for the angular lever 282 carrying the clamp 59 is inward so that the clamp fully engages the periphery of an ammunition cartridge 51 as hereinbefore described. However, when the rod 288 is retracted as shown in dashed lines in FIG. 11, the center of rotation 284 for the angular lever 282 is moved outwardly by rotation of the member 291 so that the clamp 59 is substantially moved laterally away from the periphery of the ammunition cartridge. The opposite side of the ram tray assembly 58 is similar to the side just described and includes a link 292 similar to link 221 and a rotating member 293 similar to member 291 upon which the pivot 286 for the opposite half of the clamp 59 is mounted off center from the center of rotation of the member 293. It may therefore be seen that actuation of the partial clamp opening actuators 219 and 287 together will either place the clamp pivots 284 and 286 in a position so that the cartridge may be fully engaged as in FIG. 12 or fully released as shown in dashed lines in FIG. 10 or they may be actuated to retract the rods 288 and 289 to rotate the pivot points 284 and 286 outwardly relative to the ram tray assembly and partially open the clamps as seen in dashed lines in FIG. 11. With the clamps partially opened, some guidance is still provided for the cartridge as it is rammed past the clamps, but the clamps are spaced far enough apart so that the rim of the stub case 51*a* may readily pass.

Figures 16, 17, 18:
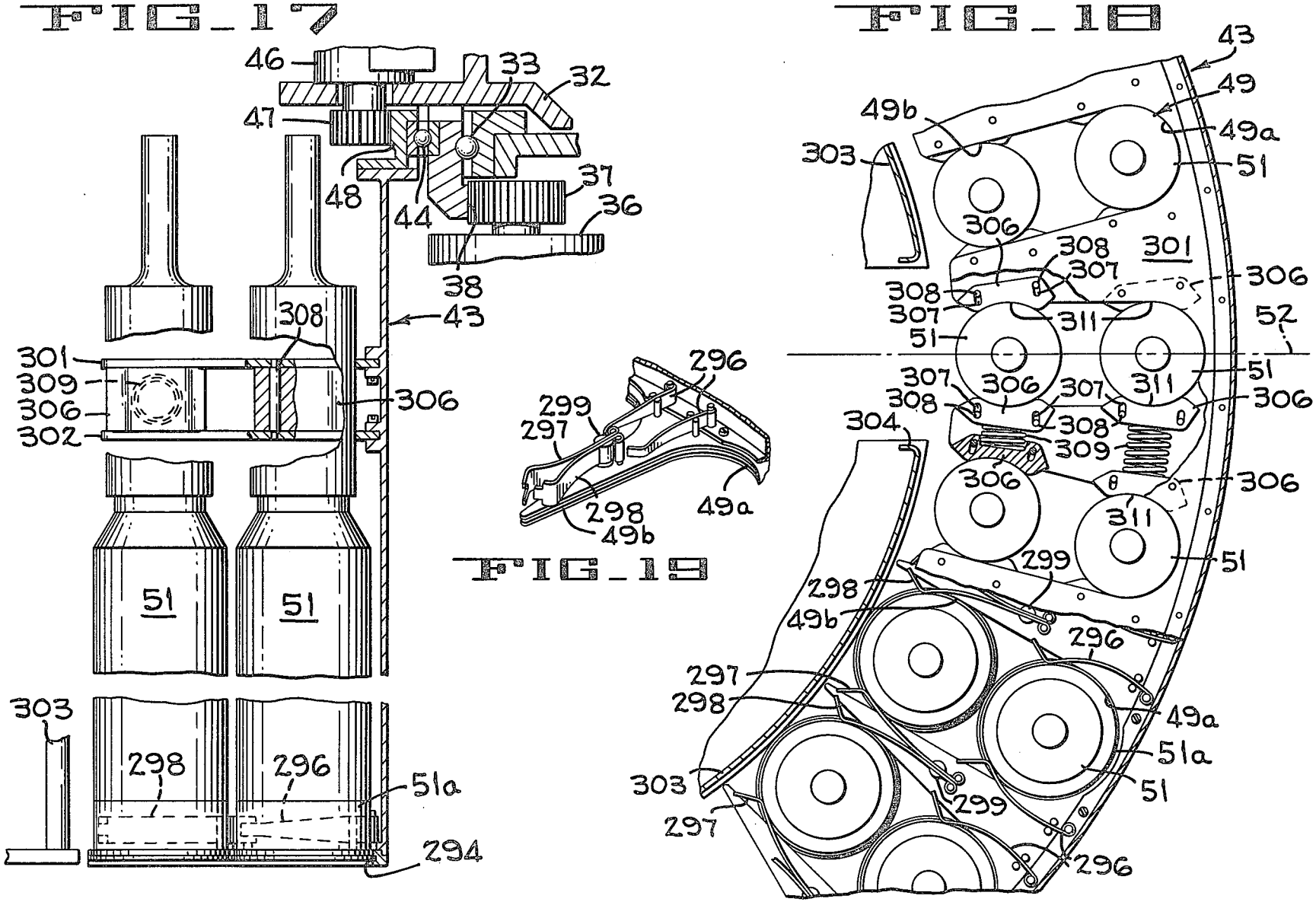
FIG. 17 is a partial section side elevation view of the magazine of the automatic loading system.
FIG. 18 is a partial section plan view of the magazine of the automatic loading system.

Referring to FIG. 17 the index drive motor 46 for the magazine 43 is seen with the attached index drive gear 47 shown meshed with the magazine mounted ring gear 48. The bearing 44 surrounding the magazine and upon which the magazine rotates is shown together with the turret bearing 33, turret mounted ring gear 38, turret drive motor 36 and turret drive gear 37 all described hereinbefore with reference to FIGS. 1 and 2. The magazine has parallel retaining channels 294 at the base thereof which engage the rims on the stub cases 51*a*. A leaf spring 296 is disposed on each side of and at the base of each outer storage cell 49*a* so that the base of the cartridge at the stub case is held within the cell by the leaf springs. Another pair of leaf springs 297 and 298 is mounted on a post 299 at the base of the magazine to contact cartridges which are inserted in the inner ring storage cells 49*b*. The leaf springs are all designed to be cammed out-of-the-way by the cartridge stub case upon insertion into the respective storage cells and will also be cammed out-of-the-way by the cartridges upon removal therefrom. It should be noted that the leaf springs 297 and 298, because of the necessity that springs servicing adjacent inner ring cells be spaced close together, are configured so that their tips will not interfere when they are cammed outwardly from the cell. Leaf spring 297 has a notch (FIG. 19) positioned so that a projection in leaf spring 298 will enter into the notch when one or the other of these leaf springs is being cammed to an out-of-the-way position as the cartridge is being inserted or withdrawn.

A pair of spaced horizontal plates 301 and 302 are attached to the inner wall of the magazine as shown in FIG. 17. The plates are cut away as seen in FIG. 18 to provide an upper definition for the bounds of the outer ring cells 49*a* and the inner ring cells 49*b*. It should also be noted in FIG. 18 that a depending cylindrical wall 303 within the turret has an opening 304 therethrough at a position defining the load position 52 for the magazine 43. Disposed between the two plates 301 and 302 on each side of each storage cell 49*a* and 49*b* is a block 306. Each of the blocks have elongate slots 307 formed therein through which a pin 308 supported between the plates passes. A spring 309 is disposed between blocks facing adjacent storage cells so that the blocks are urged toward the cells. The blocks have curved surfaces 311 on the faces disposed toward the storage cells which are configured to substantially conform to the curvature of the projectile end of a cartridge 51. The blocks also have beveled forward and rearward edges, as best seen in the plan view of FIG. 18, so that a cartridge may be placed within a storage cell or removed therefrom and will readily cam the blocks out-of-the-way against the pressure of springs 309 during the process of insertion or withdrawal. In this fashion the cartridges are held both at the base ends and at the projectile ends so that severe jarring will not loosen them from their assigned positions within the magazine.

Figure 20:
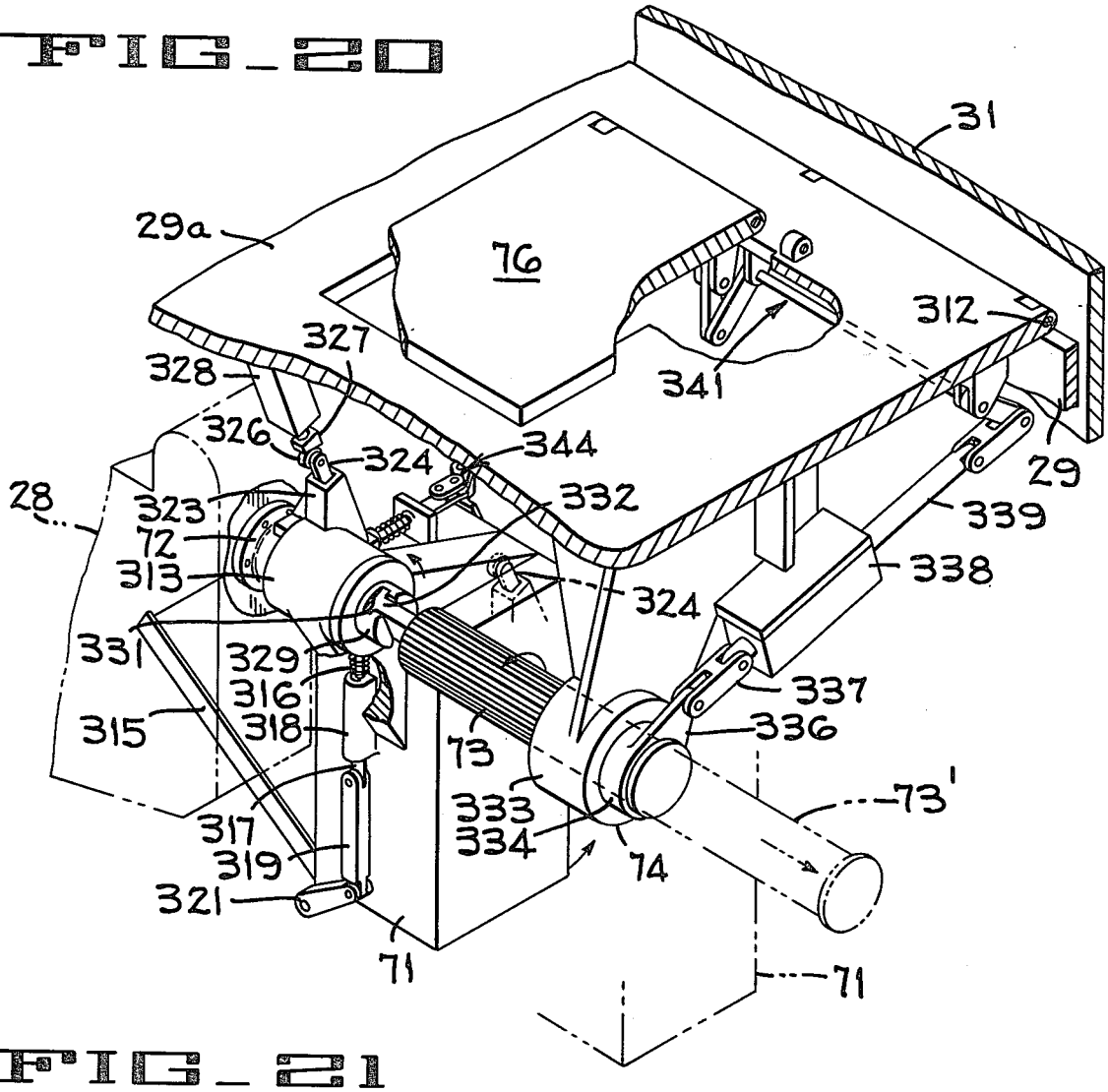
FIG. 20 is a perspective view of the cartridge stub case ejector mechanism of the automatic loading system.
Figure 21:
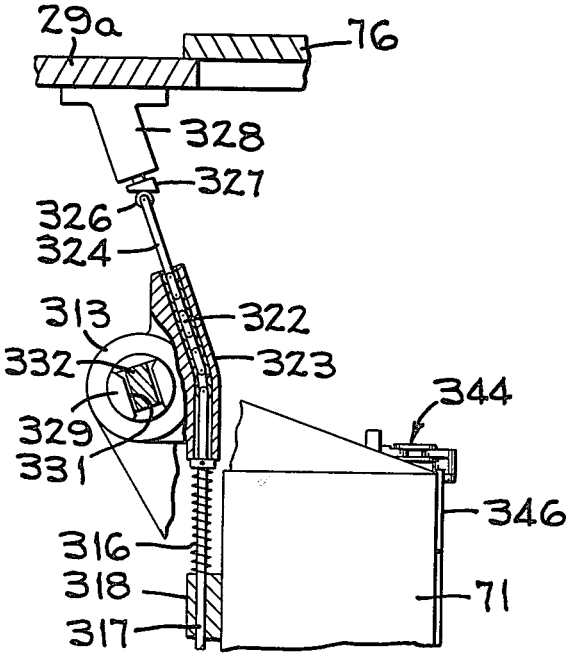
FIG. 21 is a section taken along line 21—21 of FIG. 20 showing the cartridge stub case ejector mechanism.

In FIG. 20 a perspective view of the mechanism configured to eject stub cases of fired cartridges from the turret is shown. A mantlet cover 29*a*, which is part of the mantlet 29 hereinbefore described, is shown connected by a hinge pin 312 to the sides of the mantlet. The mantlet moves within the gun enclosure structure 31 as also described hereinbefore. The pivot mount 72 is shown attached to the rear face of the breech 28 in FIG. 20 and has a rotating hub 313 thereon. The hub is attached to the stub case container 71 mentioned hereinbefore. The hub and stub case container are configured to rotate on the stub shaft or pivot mounting 72. A forward swinging door 315 is attached at a hinge along the bottom of the container as shown. The door is configured to swing down into the bottom loading opening in the breech 28. The door is spring loaded toward an open condition by a spring 316 (FIG. 21) which urges a rod 317 upwardly as seen in the Figures relative to a rod guide 318 attached to the side of the container. The rod 317 may be seen to be connected to a link 319 which is in turn connected to a lever 321 which moves with the forward swinging door. The upper end of the rod is attached to a few roller chain links 322 passing through a link guide 323 and terminating in a projecting rod 324 having a roller 326 on the end thereof. The roller is in contact with a member 327 which is mounted on the end of a rod extending from a hydraulic actuator 328. When the actuator 328 is energized the rod 324 is depressed together with the rod 317 and the link 319 so that the door 315 is urged to a closed position on the container 71.

The hub 313 has a boss 329 thereon which has a T-shaped slot 331 therethrough which accepts a T-shaped member shown at 332. The T-shaped member is attached to the elongate spline 73 mentioned in conjunction with the description of FIG. 2. The driving member 74 for the spline includes a collar 333 which has a bearing mounted rotatable member 334 therein having internal axially extending teeth which mesh with the spline. A lever 336 is attached to the member 334. A link 337 is pivotally attached between the lever and a rod 339 extending through an operating cylinder 338 for providing both rotation of the container 71 and opening and closing of the stub case ejection door 76. As seen in FIG. 20, when the operating cylinder causes the rod 339 to move toward the lever 336 as seen in FIG. 20 the spline 73 is rotated and a linkage shown generally at 341 attached to the opposite end of the rod 339 causes the door 76 to assume an open condition as shown in FIG. 1.

Figure 22:
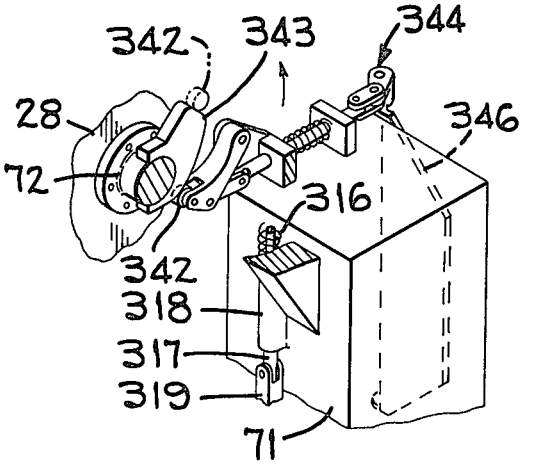
FIG. 22 is a detail view of the cartridge stub case ejector mechanism of FIG. 20.
Figure 37:
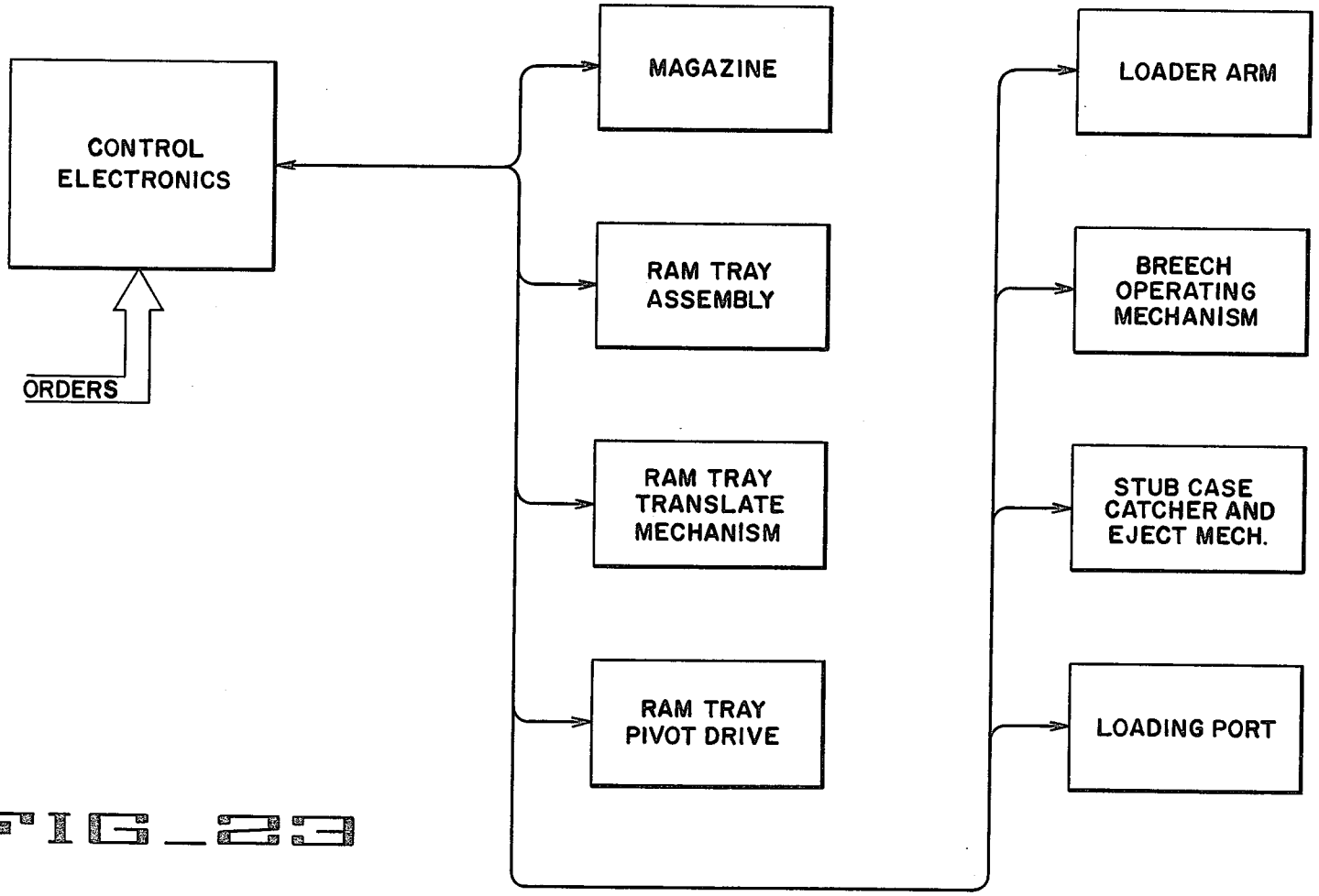

When the container 71 has received an ejected stub case from the breech 28 and the actuator 328 has urged the door 315 into a closed position, the operating cylinder 338 is then energized to cause the spline 73 to rotate as previously described. Upon a relatively small angle of rotation it may be seen that the roller 326 departs from the member 327. At this point however the closed door 315 is captured between the container and the back of the breech 28 and the spring 316 is no longer able to urge it into an open condition. As the container rotates with the spline 73 and the stub case ejection door 76 is urged into an open position, a cam follower 342 (FIG. 22) rides on the surface of a cam 343 which is mounted on the stub shaft or pivot mounting 72 for the container 71. The follower is attached to the end of linkage 344 mounted on the top of the stub case container. With the follower 342 in the position shown in solid lines in FIG. 22 a side door 346 on the container is in a closed position. When the container has rotated to a position such that the follower is in the position shown in dashed lines in FIG. 22, the linkage 344 is moved to cause the door 346 to assume an open position, as shown in FIG. 1. As a result, the stub case from the fired cartridge is flung from the container through the open door and outside the turret.

It should be noted that the mantlet cover 29a may be rotated to an open position about the hinge pin 312. The actuator 328 for the front container door 315 is attached to the underside of the mantlet cover as well as the collar 333 and the operating cylinder 338 for the spline driving member 74 and the ejection door opening linkage 341. The member 327 and the roller 326 in the forward container door opening linkage is able to readily separate when the mantlet cover is opened. Also the T-shaped member 332 easily separates from the T-shaped slot 331 in the boss 329 attached to the stub case container when the cover opens. When the mantlet cover 29a is again placed in the lowered or closed condition, the T-shaped member is again engaged in the slot and the actuator member 327 is once again brought to bear against the roller 326. It should further be noted that since the container 71 is attached to the rear surface of the breech 28, gun recoil will cause the container and the mechanism attached thereto to move rearwardly during recoil. The spline 73 is elongate as shown so that during recoil it may slide axially rearwardly and then forwardly through the rotatable member 334, reaching the position as shown in dotted lines at 73' in FIG. 20 at the maximum recoil position.

The control logic of the automatic loading system controller of the present invention is a microprocessor based computer which accepts the position sensor inputs from all of the movable mechanical components hereinbefore described. The position sensors need not be individually described, but are present to detect and provide signal indications of the positions of the various mechanisms by means such as stall effect and eddy current proximity switches, optical switches and mechanical switches. The controller is programmed to process the information obtained relative to the automatic loader component positions and the selected operating mode and to thereby make the logic decisions required to energize the appropriate actuators hereinbefore described in the proper sequence for automatic handling in accordance with the selected mode. The microprocessor makes its decisions based on inputs from the fire control processor as well. Multiple modes of operation are available through the controller. Further, the controller keeps record of ammunition type inventory and where the cartridges are located within the automatic loader. With reference to FIG. 23 of the drawings the control electronics receives information from and transmits command signals to the magazine 43, the ram tray assembly 58, the ram tray telescoping mechanism 57, the telescoping mechanism pivot drive 61, the loader arm 53, the breech operating mechanism, the stub case ejection mechanism, and the loading door 30 covering the loading port 45. Appropriate operator and program inputs are provided also to the control electronics to provide any one of several automatic loading system operating modes.

Figure 24B:
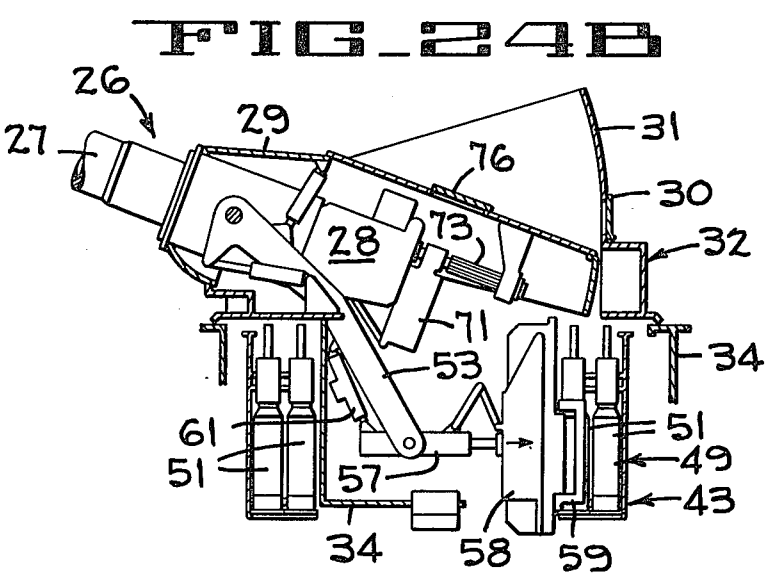
FIGS. 24A through 24H are side elevation section views showing an operational sequence of the automatic loading system.
Figure 24D:
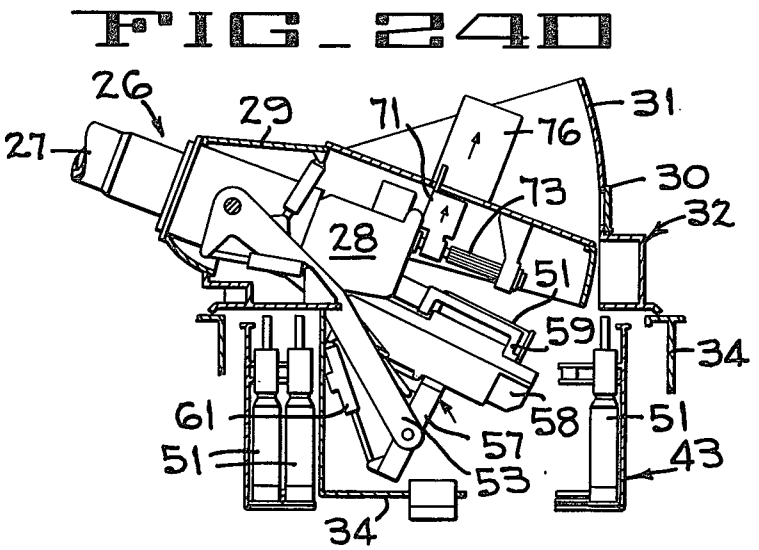
Figure 24A:
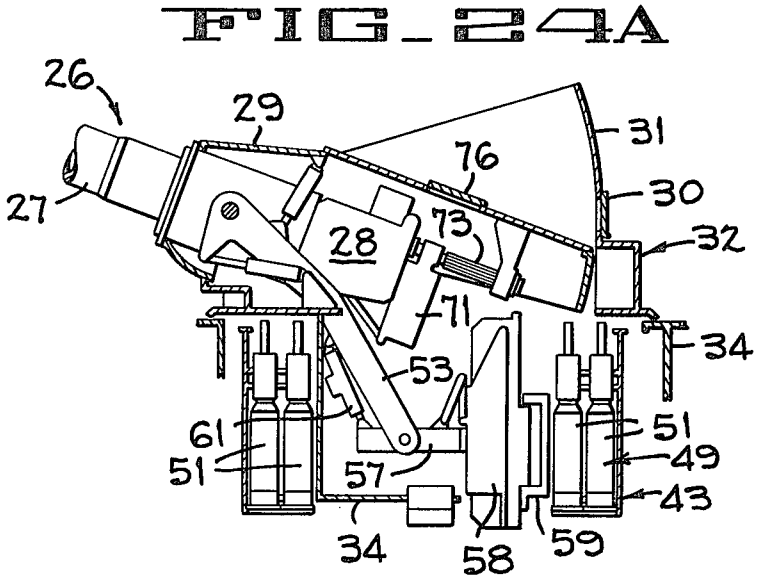
Figure 24C:
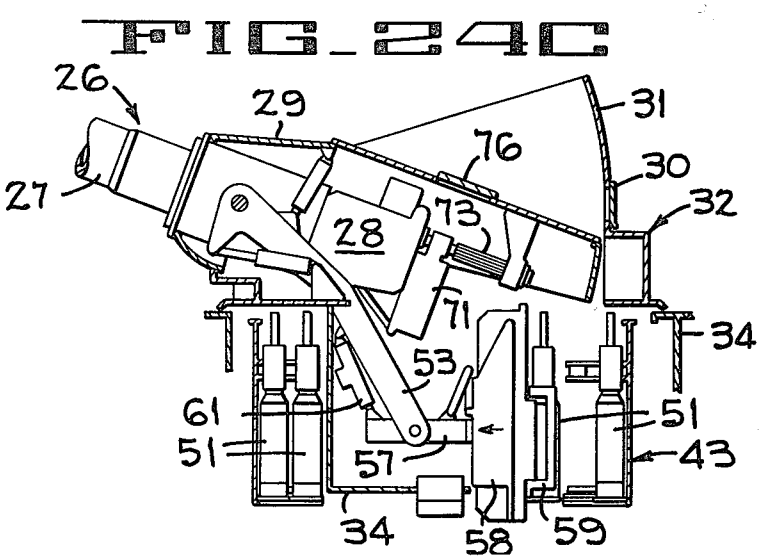
Figure 24F:
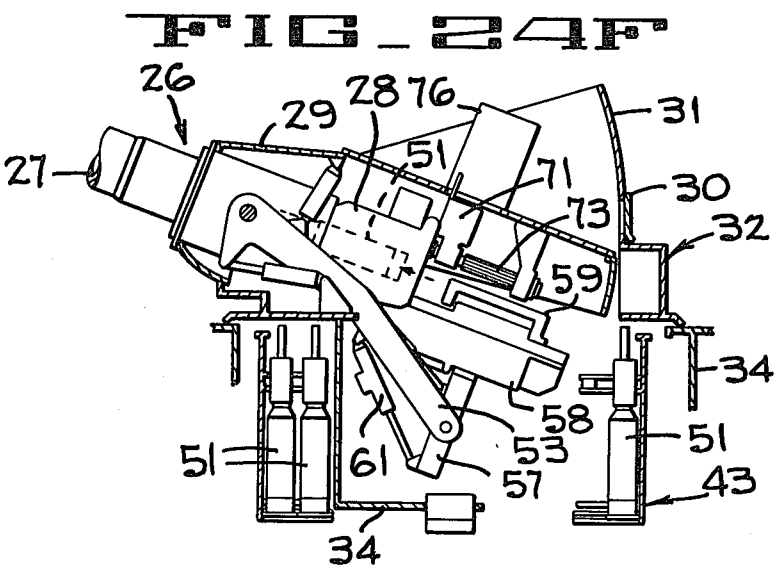
Figure 24H:
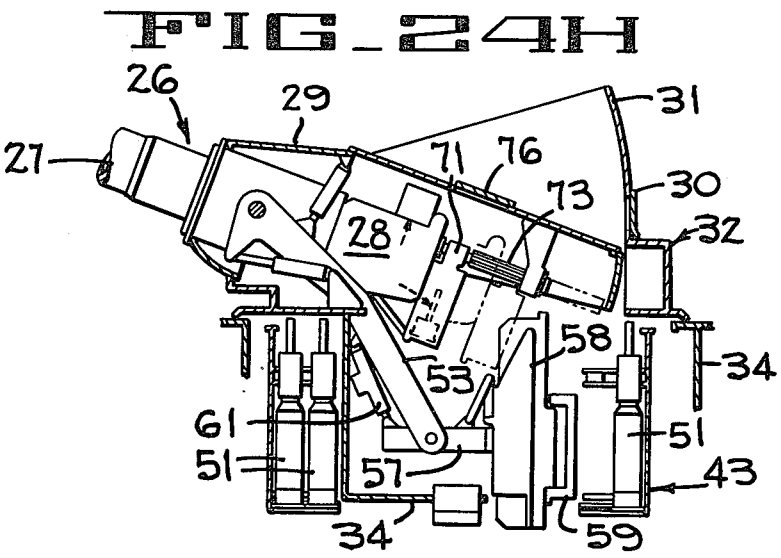
Figure 24E:
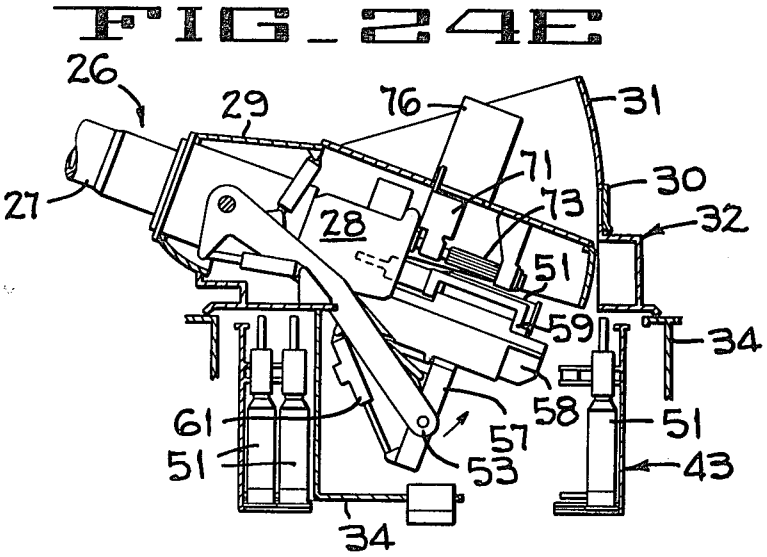
Figure 24G:
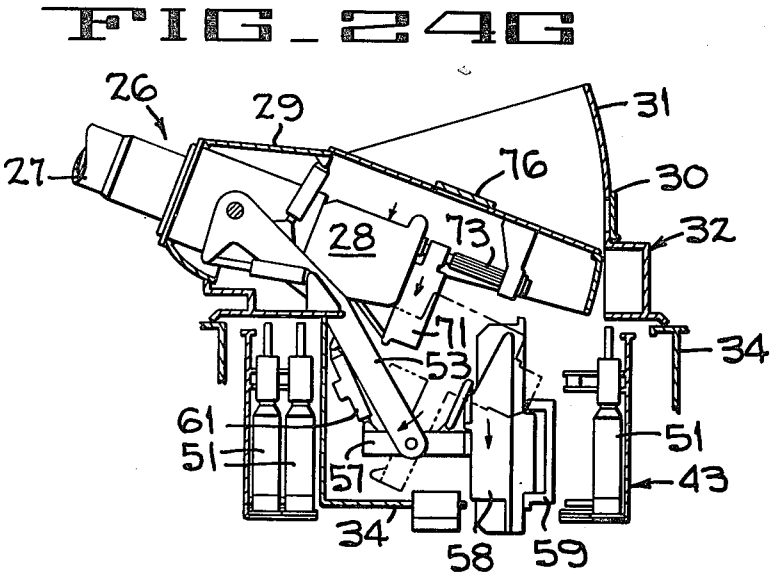

With reference now to FIGS. 24A through 24H, the normal firing mode will be described. In FIG. 24A the ram tray assembly 58 and telescoping arm 57 are seen in the ready condition with the clamps 59 fully open. The telescoping arm extends the ram tray toward the inner (or outer) cell of the stack 49 at the load position 52 as determined by the controller. The clamps are closed securing the cartridge in the tray and cartridge type identification sensors on the ram tray verify that the cartridge is the type ordered while the mechanism is in the condition shown in FIG. 24B. The stub case ejector mechanism is cleared from the rear of the breech and the telescoping arm is retracted withdrawing the cartridge from the magazine by overcoming the retaining forces exerted by the projectile and stub case retaining mechanisms (FIGS. 17, 18 and 19). The controller updates the magazine inventory status and the breech is opened to produce the condition shown in FIG. 24C. The ram tray and telescoping arm is pivoted by actuation of the hydraulic cylinder 61 so that the ram tray is placed in the intermediate position with the cartridge axis pointed toward the gun elevation axis as seen in FIG. 24D. The loader arm 53 is unlatched from the lowered position and raised to its up and latched position wherein the ram tray is automatically aligned with the gun breech at any gun angle of elevation as hereinbefore described and as seen in FIG. 24E. The ram tray clamps 59 are partially opened and the cartridge is rammed through the chute provided thereby by the ram pawl. The cartridge is thereby inserted into the breech and the breech block moves to a partially closed position so that the cartridge is secured within the breech. The rammer is retracted and simultaneously the loader arm 53 is unlatched from the raised position and moved to the lowered position where it is latched as seen in FIG. 24G. The ram tray assembly is then lowered from the position shown in dashed lines in FIG. 24G to the position shown in solid lines by the pivoting action of the telescoping arm 57, and when the ram tray assembly is clear of the breech area the breech is fully closed. The stub case ejector mechanism is lowered to a position behind the breech. The gun is fired and recoil occurs. The breech is opened and the stub case from the spent cartridge is ejected into the stub case container 71 which is moved by the ejector mechanism as hereinbefore described to throw the stub case out of the turret through the ejection door 76, as shown in part in FIG. 24H.

Additional modes may be implemented by the controller for the automatic loading system. A misfire mode is implemented when a misfire is determined and the misfired cartridge must be removed from the breech and cast out of the turret through the loading hatch 45 with the gun at zero elevation. The ram pawl and ram latch perform this function under orders from the controller as described hereinbefore. An unload mode performs the normal loading to fire sequence described in conjunction with FIGS. 24A through 24H in reverse. In this mode the gun need not be returned to zero elevation and the loading port door 30 need not be opened.

A replenish mode may be implemented in which the automatic loading system receives ammunition through the loading port 45 to restock the magazine 43. The rounds being loaded are identified and recorded in memory together with their location within the forty-eight storage cells within the magazine. An off-load mode is provided wherein the automatic loading system performs the replenishment sequence in reverse to remove fixed ammunition cartridges from the magazine and to present them for off-loading from the turret through the loading hatch.

Although the best mode contemplated for carrying out the present invention has been herein shown and described, it will be apparent that modification and variation may be made without departing from what is regarded to be the subject matter of the invention.

We claim:

1. An automatic loading system for moving large caliber fixed ammunition within a turret which is rotatable about an azimuth axis relative to a turret support structure, wherein a gun barrel is mounted in the turret for movement in elevation relative thereto about an elevation axis, comprising an ammunition magazine disposed in the turret and rotatable about an axis substantially parallel to the aximuth axis, said magazine being annular in shape and having a plurality of ammunition holding cells therein, said cells being adapted to accommodate and retain fixed ammunition cartridges, means for angularly indexing said annular magazine to position predetermined ones of said holding cells at a load position, a loader arm pivotally attached to the turret at one end, a ram tray assembly pivotally mounted on the other end of said loader arm and being adapted to receive, engage and disengage fixed ammunition cartridges, means positioned on said loader arm for translating and rotating said ram tray assembly between said load position, wherein an ammunition cartridge may be moved between a holding cell and said tray, and an intermediate tray position, wherein the cartridge long axis substantially intersects the elevation axis, means positioned on said turret for rotating said loader arm to move said ram tray assembly between said intermediate position and a ram position aligned with the breech of the gun barrel when the barrel is at an arbitrary elevation relative to the turret, means for moving ammunition cartridges into and out of said ram tray, means for receiving from the breech and for discharging spent cartridge stub cases, and means for controlling the actuation sequence of said means for indexing, means for translating and rotating said ram tray, means for rotating said loader arm, means for moving ammunition cartridges, and means for receiving and discharging spent stub cases to operate the system in a preselected mode.

2. An automatic loading system as in claim 1 wherein said ammunition magazine comprises a carousel having an inner and an outer ring of holding cells thereon, whereby angular indexing of said carousel brings predetermined ones of said holding cells to said load position.

3. An automatic loading system as in claim 1 wherein a predetermined ammunition cartridge in a holding cell may be designated to be delivered to said load station and wherein said means for indexing comprises a carousel drive mounted on the turret operating to incrementally rotate said carousel to bring the adjacent holding cell into said load position, means for sensing the rotational increments of said carousel, and wherein said means for controlling includes means for commanding said carousel drive to rotate said carousel through multiple increments to bring said holding cell to said load station, and memory means for tabulating the locations and types of rounds in said holding cells.

4. An automatic loading system as in claim 1 wherein said means for moving ammunition cartridges into and out of said ram tray is mounted within said ram tray assembly and comprises a ram pawl, a ram latch pivotally attached to said pawl, and means for driving said ram latch and pawl assembly in alternate directions along the length of said tray, so that cartridges engaged by said ram and pawl may be moved between the gun breech and said tray by said ram pawl and said ram latch respectively.

5. An automatic loading system as in claim 1 or 4 wherein said ram tray comprises a cartridge clamp, means for partially opening said clamp, and means for fully opening said clamp.

6. An automatic loading system as in claim 1 wherein said means for translating and rotating said ram tray assembly comprises, a telescoping member disposed between said ram tray and said loader arm operating to position said ram tray between an extended position within said holding cell at said load station and a retracted position, and means for driving said ram tray pivotally on said loader arm between said retracted position and said intermediate position.

7. An automatic loading system as in claim 1 wherein said means for receiving and discharging spent cartridge stub cases comprises a container adapted to receive the spent cartridge stub cases, and means for rotating said container between a receiving position aligned with the gun breech and an out-of-the-way case discharge position.

8. An automatic loading system for fixed ammunition cartridges for a large caliber gun movable about an elevation axis on trunnions and carried in gun support structure, comprising a magazine disposed within the gun support structure below the gun trunnions and mounted for rotation relative to the gun support structure, said magazine having a plurality of fixed ammunition cartridge storage cells therein, means for indexing said magazine rotationally to bring predetermined ones of said storage cells into a load position, a loader arm mounted for rotational movement on the gun support structure, a ram tray mounted for rotational movement on said loader arm, means for urging ammunition rounds into and out of said ram tray, means for translating and rotating said ram tray between a position aligned with said load position and an intermediate position wherein the long axis of a cartridge therein substantially intersects the elevation axis, means for rotating said loader arm to move said ram tray between said intermediate position and a ram position aligned with the gun breech at any gun elevation, means for receiving spent cartridge cases from the breech and for discharging the cases through the gun support structure, and means for controlling actuation of said means for indexing, means for urging, means for translating and rotating, means for rotating and means for receiving in appropriate sequence to operate the system in a selected mode.

9. An automatic loading system as in claim 8 wherein said magazine comprises a carousel, said carousel having an inner and an outer ring of ammunition cartridge holding cells, whereby rotation of said carousel brings predetermined ones of said holding cells to said load position.

10. An automatic loading system as in claim 8 wherein said means for indexing comprises a carousel drive mounted on the gun support structure, and means for sensing the rotational position of said carousel, said means for controlling utilizing said means for sensing to cause said carousel drive to bring a predetermined one of said holding cells to said loading position.

11. An automatic loading system as in claim 8 wherein said means for urging is mounted within said ram tray and comprises a ram pawl, a ram latch pivotally attached to said pawl, said pawl and latch both being adapted to engage ammunition cartridges, and means for driving said ram latch and pawl together in alternate directions along said ram tray length so that cartridges may be positioned within the breech of the gun by said ram pawl and removed from the breech by said ram latch.

12. An automatic loading system as in claim 8 or 11 wherein said ram tray includes a cartridge clamp, means for partially opening said clamp, and means for fully opening said clamp.

13. An automatic loading system as in claim 8 wherein said means for receiving and discharging spent cartridge cases comprises a container adapted to receive the spent cartridge cases, and means coupled to said container for moving said contrainer between a receiving position aligned with the gun breech and an out-of-the-way case discharge position.

14. An automatic loading system as in claim 13 wherein said container is mounted on the gun breech and said means for moving said container is mounted on the gun support structure.

15. An unmanned loading system for moving large caliber fixed ammunition rounds within a turret which is rotatable about an azimuth axis and which has a gun tube mounted therein which is movable within the turret about an elevation axis, comprising an annular ammunition magazine disposed within the turret independently rotatable substantially about the azimuth axis, a plurality of cartridge storage cells disposed about the periphery of said magazine, means for angularly indexing said magazine to bring ones of said cells to a load position on the turret, a loader arm pivotally attached to the turret and disposed to rotate about the elevation axis, means for rotating said loader arm between a lowered and a raised position, a ram tray assembly pivotally attached to the free end of said loader arm, means for rotating said ram tray assembly between a lowered magazine position surrounded by said magazine and a raised intermediate position when said loader arm is lowered, said ram tray axis for receiving ammunition cartridges being substantially parallel to said storage cells axes in said magazine position and an extension of said axis substantially intersecting the elevation axis in said intermediate position, means for locating said loader arm raised position at any gun tube elevation so that said ram tray axis is substantially aligned with the gun breech when said tray is in said intermediate position, means mounted on said ram tray assembly for receiving, engaging and disengaging fixed ammunition cartridges, means for translating said ram tray assembly between a retracted and an extended position in said magazine position, so that said ram tray is at said load position when extended, means for receiving and discharging spent cartridge stub cases from the breech, and means for controlling sequence of actuation of said means for angularly indexing, means for rotating said loader arm and ram tray assembly, means for engaging and disengaging, means for translating said ram tray, and means for receiving and discharging spent cartridge stub cases in appropriate sequence to operate the system in a selected mode, said means for controlling including memory means for tabulating the locations and types of rounds in said cartridge storage cells.

* * * * *